US007124826B2

(12) United States Patent
Simpson

(10) Patent No.: US 7,124,826 B2
(45) Date of Patent: Oct. 24, 2006

(54) PROCEDURES AND EQUIPMENT FOR PROFILING AND JOINTING OF PIPES

(75) Inventor: Neil Andrew Abercrombie Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 231 days.

(21) Appl. No.: 10/750,208

(22) Filed: Dec. 31, 2003

(65) Prior Publication Data

US 2004/0226723 A1 Nov. 18, 2004

Related U.S. Application Data

(63) Continuation of application No. 10/217,833, filed on Aug. 13, 2002, now Pat. No. 6,702,030, which is a continuation of application No. 09/469,690, filed on Dec. 22, 1999, now Pat. No. 6,457,532.

(30) Foreign Application Priority Data

| | | |
|---|---|---|
| Dec. 22, 1998 | (GB) | 9828234.6 |
| Jan. 15, 1999 | (GB) | 9900835.1 |
| Oct. 8, 1999 | (GB) | 9923783.6 |
| Oct. 13, 1999 | (GB) | 9924189.5 |

(51) Int. Cl.
*E21B 23/02* (2006.01)

(52) U.S. Cl. ..... 166/380; 166/207

(58) Field of Classification Search ..... 166/380, 166/207, 558; 72/75, 118, 119, 393
See application file for complete search history.

(56) References Cited

U.S. PATENT DOCUMENTS

| | | | |
|---|---|---|---|
| 761,518 | A | 5/1904 | Lykken |
| 1,324,303 | A | 12/1919 | Carmichael |
| 1,545,039 | A | 7/1925 | Deavers |
| 1,561,418 | A | 11/1925 | Duda |

(Continued)

FOREIGN PATENT DOCUMENTS

| | | | |
|---|---|---|---|
| EP | 0 961 007 | A2 | 12/1999 |

(Continued)

OTHER PUBLICATIONS

Canadian Office Action, Canadian Patent Application No. 2,356,194, dated Feb. 24, 2005.

(Continued)

*Primary Examiner*—William Neudor
(74) *Attorney, Agent, or Firm*—Patterson & Sheridan, L.L.P.

(57) ABSTRACT

Methods and apparatus for shaping pipes, tubes, liners, or casing at downhole locations in wells. Use is made of rollers bearing radially outwards against the inside wall of the pipe (etc.), the rollers being rolled around the pipe to cause outward plastic deformation which expands and shapes the pipe to a desired profile. Where one pipe is inside another, the two pipes can be joined without separate components (except optional seals). Landing nipples and liner hangers can be formed in situ. valves can be deployed to a selected downhole location and there sealed to the casing or liner without separate packers. Casing can be deployed downhole in reduced-diameter lengths and then expanded to case a well without requiring larger diameter bores and casing further uphole. The invention enables simplified downhole working, and enables a well to be drilled & produced with the minimum downhole bore throughout its depth, obviating the need for large bores. When expanding lengths of casing, the casing does not need to be anchored or made pressure-tight. The profiling/expansion tools of the invention can be deployed downhole on coiled tubing, and operated without high tensile loads on the coiled tubing.

22 Claims, 25 Drawing Sheets

U.S. PATENT DOCUMENTS

| | | | | |
|---|---|---|---|---|
| 1,569,729 | A | | 1/1926 | Duda |
| 1,597,212 | A | | 8/1926 | Spengler |
| 1,930,825 | A | | 10/1933 | Raymond |
| 1,981,525 | A | | 11/1934 | Price |
| 2,383,214 | A | | 4/1945 | Prout et al. |
| 2,499,630 | A | | 3/1950 | Clark |
| 2,627,891 | A | | 2/1953 | Clark |
| 2,663,073 | A | | 12/1953 | Bieber et al. |
| 2,754,577 | A | | 7/1956 | Maxwell |
| 2,898,971 | A | | 8/1959 | Hempel |
| 3,087,546 | A | | 4/1963 | Woolley |
| 3,195,646 | A | | 7/1965 | Brown |
| 3,467,180 | A | | 9/1969 | Pensotti |
| 3,785,193 | A | | 1/1974 | Kinley et al. |
| 3,818,734 | A | | 6/1974 | Bateman |
| 3,885,298 | A | | 5/1975 | Pogorowski |
| 3,911,707 | A | | 10/1975 | Minakov et al. |
| 4,069,573 | A | | 1/1978 | Rogers et al. |
| 4,090,382 | A | | 5/1978 | Schott |
| 4,127,168 | A | | 11/1978 | Hanson et al. |
| 4,159,564 | A | | 7/1979 | Cooper |
| 4,288,082 | A | | 9/1981 | Setterberg |
| 4,324,407 | A | | 4/1982 | Upham et al. |
| 4,371,199 | A | | 2/1983 | Kushner et al. |
| 4,429,620 | A | | 2/1984 | Burkhardt et al. |
| 4,483,399 | A | | 11/1984 | Colgate |
| 4,502,308 | A | | 3/1985 | Kelly |
| 4,531,581 | A | | 7/1985 | Pringle et al. |
| 4,588,030 | A | | 5/1986 | Blizzard |
| 4,697,640 | A | | 10/1987 | Szarka |
| 4,848,469 | A | | 7/1989 | Baugh et al. |
| 5,083,608 | A | * | 1/1992 | Abdrakhmanov et al. .... 166/55 |
| 5,271,472 | A | | 12/1993 | Leturno |
| 5,322,127 | A | | 6/1994 | McNair et al. |
| 5,409,059 | A | | 4/1995 | McHardy |
| 5,435,400 | A | | 7/1995 | Smith |
| 5,472,057 | A | | 12/1995 | Winfree |
| 5,560,426 | A | | 10/1996 | Trahan et al. |
| 5,685,369 | A | | 11/1997 | Ellis et al. |
| 5,901,787 | A | | 5/1999 | Boyle |
| 6,021,850 | A | | 2/2000 | Wood et al. |
| 6,070,671 | A | | 6/2000 | Cumming et al. |
| 6,098,717 | A | | 8/2000 | Bailey et al. |
| 6,325,148 | B1 | | 12/2001 | Trahan et al. |
| 6,425,444 | B1 | | 7/2002 | Metcalfe et al. |
| 6,446,323 | B1 | | 9/2002 | Metcalfe et al. |
| 6,135,208 | A1 | | 10/2002 | Gano et al. |
| 6,527,049 | B1 | | 3/2003 | Metcalfe et al. |
| 6,543,552 | B1 | | 4/2003 | Metcalfe |
| 6,702,029 | B1 | | 3/2004 | Metcalfe et al. |
| 6,702,030 | B1 | | 3/2004 | Simpson |
| 6,457,532 | B1 | | 10/2004 | Simpson |

FOREIGN PATENT DOCUMENTS

| | | | |
|---|---|---|---|
| FR | 2 471 907 | | 11/1995 |
| GB | 1448304 | | 9/1976 |
| GB | 1457843 | | 12/1976 |
| GB | 2216926 | A | 10/1989 |
| GB | 2320734 | A | 7/1998 |
| GB | 2329918 | | 4/1999 |
| GB | 2313860 | B | 11/2000 |
| RU | 2002035 | C1 | 7/1991 |
| RU | 2064357 | C1 | 7/1996 |
| RU | 2144128 | C1 | 10/2000 |
| SU | 1 745 873 | | 7/1992 |
| WO | WO 93/24728 | A1 | 9/1993 |
| WO | WO 99/18328 | | 4/1999 |
| WO | WO 99/23354 | | 5/1999 |
| WO | WO 99 35368 | | 7/1999 |

OTHER PUBLICATIONS

EP Search Report, Application No. 05105467.4—2302 PCT, dated Aug. 31, 2005.

* cited by examiner

PROCEDURES AND EQUIPMENT FOR PROFILING AND JOINTING OF PIPES

CROSS-REFERENCE TO RELATED APPLICATIONS

This application is a continuation of U.S. patent application Ser. No. 10/217,833, filed Aug. 13, 2002 now U.S. Pat. No. 6,702,030 which is a continuation of now U.S. application Ser. No. 09/469,690 filed Dec. 22, 1999, now U.S. Pat. No. 6,457,532, issued Oct. 1, 2002, which claims benefit of United Kingdom application Ser. No. 9828234.6, filed Dec. 22, 1998, United Kingdom application Ser. No. 9900835.1, filed Jan. 15, 1999; United Kingdom application Ser. No. 9923783.6, filed Oct. 8, 1999 and United Kingdom application Ser. No. 9924189.5, filed Oct. 13, 1999. Each of the aforementioned related patent application is herein incorporated by reference.

BACKGROUND OF THE INVENTION

Field of the Invention

This invention relates to procedures and equipment for profiling and jointing of pipes, and relates more particularly but not exclusively to methods and apparatus for the shaping and/or expansion and/or conjoining of tubular casings in wells.

In the hydrocarbon exploration and production industry there is a requirement to deploy tubular casings in relatively narrow-bore wells, and to expand the deployed casing in situ. The casing may require to be expanded throughout its length in order to line a bore drilled through geological material; the casing may additionally or alternatively require to be expanded at one end where it overlaps and lies concentrically within another length of previously deployed casing in order to form a swaged joint between the two lengths of casing. Proposals have been made that a slotted metal tube be expanded by mechanically pulling a mandrel through the tube, and that a solid-walled steel tube be expanded by hydraulically pushing a part-conical ceramic plunger through the tube. In both of these proposals, very high longitudinal forces would be exerted throughout the length of the tubing, which accordingly would require to be anchored at one end. Where mechanical pulling is to be employed, the pulling force would require to be exerted through a drillstring (in relatively large diameter wells) or through coiled tubing (in relatively small diameter wells). The necessary force would become harder to apply as the well became more deviated (i.e. more non-vertical), and in any event, coiled tubing may not tolerate high longitudinal forces. Where hydraulic pushing is to be employed, the required pressure may be hazardously high, and in any event the downhole system would require to be pressure-tight and substantially leak-free. (This would preclude the use of a hydraulically pushed mandrel for the expansion of slotted tubes). The use of a fixed-diameter mandrel or plug would make it impracticable or impossible to control or to vary post-deformation diameter after the start of the expansion procedure.

It is therefore an object of the invention to provide new and improved procedures and equipment for the profiling or jointing of pipes or other hollow tubular articles, which obviate or mitigate at least some of the disadvantages of the prior art.

In the following specification and claims, references to a "pipe" are to be taken as references to a hollow tubular pipe and to other forms of hollow tubular article, and references to "profiling" are to be taken as comprising alteration of shape and/or dimension(s) which alteration preferably takes place substantially without removal of material.

BRIEF SUMMARY OF THE INVENTION

According to a first aspect of the present invention there is provided a profiling method for profiling a pipe or other hollow tubular article, the profiling method comprising the steps of applying a roller means to a part of the pipe bore selected to be profiled, translating the roller means across the bore in a direction including a circumferential component while applying a force to the roller means in a radially outwards direction with respect to the longitudinal axis of the pipe, and continuing such translation and force application until the pipe is plastically deformed substantially into the intended profile.

The deformation of the pipe may be accomplished by radial compression of the pipe wall or by circumferential stretching of the pipe wall, or by a combination of such radial compression and circumferential stretching.

Said direction may be purely circumferential, or said direction may partly circumferential and partly longitudinal.

Said roller means is preferably peripherally profiled to be complementary to the profile into which the selected part of the pipe bore is intended to be formed.

The selected part of the pipe bore may be remote from an open end of the pipe, and the profiling method then comprises the further steps of inserting the roller means into the open end of the pipe (if the roller means it not already in the pipe), and transferring the roller means along the pipe to the selected location. Transfer of the roller means is preferably accomplished by the step of actuating traction means coupled to or forming part of the roller means and effective to apply along-pipe traction forces to the roller means by reaction against parts of the pipe bore adjacent the roller means.

The profiling method according to the first aspect of the present invention can be applied to the profiling of casings and liners deployed in a well (e.g. a hydrocarbon exploration or production well), and the profile created by use of the method may be a liner hanger, or a landing nipple, or another such downhole profile of the type which previously had to be provided by inserting an annular article or mechanism into the well, lowering it the required depth, and there anchoring it (which required either a larger diameter of well for a given through diameter, or a restricted through diameter for a given well diameter, together with the costs and inconvenience of manufacturing and installing the article or mechanism). Additionally or alternatively, the profiling method according to the first aspect of the present invention can be applied to increasing the diameter of a complete length of pipe; for example, where a well has been cased to a certain depth (the casing having a substantially constant diameter), the casing can be extended downwardly by lowering a further length of pipe (of lesser diameter such that it freely passes down the previously installed casing) to a depth where the top of the further length lies a short way into the lower end of the previously installed casing and there expanding the upper end of the further length to form a joint with the lower end of the previously installed casing (e.g. by using the method according to the second aspect of the present invention), followed by circumferential expansion of the remainder of the further length to match the bore of the previously installed casing.

According to a second aspect of the present invention there is provided a conjoining method for conjoining two pipes or other hollow tubular articles, said conjoining method comprising the steps of locating one of the two pipes within and longitudinally overlapping one of the other of the two pipes, applying roller means to a part of the bore of the inner of the two pipes at a location where it is intended that the two pipes be conjoined, translating the roller means across the bore in a direction including a circumferential component while applying a radially outwardly directed force to the roller means, and continuing such translation and force application until the inner pipe is plastically deformed into permanent contact with the outer pipe and is thereby conjoined thereto.

Said deformation may be accomplished by radial compression of the pipe wall or by circumferential stretching of the pipe wall, or by a combination of such radial compression and circumferential stretching.

Said direction may be purely circumferential, or said direction may be partly circumferential and partly longitudinal.

The location where the pipes are intended to be conjoined may be remove from an accessible end of the bore, and the conjoining method then comprises the further steps of inserting the roller means into the accessible end of the bore (if the roller means is not already in the bore), and transferring the roller means to the intended location. Transfer of the roller means is preferably accomplished by the step of actuating traction means coupled to or forming part of the roller means and effective to apply along-bore traction forces to the roller means by reaction against parts of the pipe bore adjacent the roller means.

The conjoining method according to the second aspect of the present invention can be applied to the mutual joining of successive lengths of casing or liner deployed in a well (e.g. a hydrocarbon exploration or production well), such that conventional screw-threaded connectors are not required.

According to third aspect of the present invention, there is provided expansion apparatus for expanding a pipe or other hollow tubular article, said expansion apparatus comprising roller means constructed or adapted for rolling deployment against the bore of the pipe, said roller means comprising at least one set of individual rollers each mounted for rotation about a respective rotation axis which is generally parallel to the longitudinal axis of the apparatus, the rotation axes of said at least one set of rollers being circumferentially distributed around the expansion apparatus and each being radially offset from the longitudinal axis of the expansion apparatus, the expansion apparatus being selectively rotatable around its longitudinal axis.

The rotation axes of said at least one set of rollers may conform to a first regime in which each said rotation axis is substantially parallel to the longitudinal axis of the expansion apparatus in a generally cylindrical configuration, or the rotation axes of said at least one set of rollers may conform to a second regime in which each said rotation axis lies substantially in a respective radial plane including the longitudinal axis of the expansion apparatus and the rotation axes each converge substantially towards a common point substantially on the longitudinal axis of the expansion apparatus in a generally conical configuration, or the rotation axes of said at least one set of rollers may conform to third regime in which each said rotation axis is similarly skewed with respect to the longitudinal axis of the expansion apparatus in a generally helical configuration which may be non-convergent (cylindrical) or convergent (conical). Rollers in said first regime are particularly suited to profiling and finish expansion of pipes and other hollow tubular articles, rollers in said second regime are particularly suited to commencing expansion in, and to flaring of pipes, and other hollow tubular articles, while rollers in said third regime are suited to providing longitudinal traction in addition to such functions of the first or second regimes as are provided by other facets of the roller axes besides skew. The expansion apparatus may have only a single such set of rollers, or the expansion apparatus may have a plurality of such sets of rollers which may conform to two or more of the aforesaid regimes of roller axis alignments; in a particular example where the expansion apparatus has a set of rollers conforming to the second regime located at leading end of the exemplary expansion apparatus and another set of rollers conforming to the first regime located elsewhere on the exemplary expansion apparatus, this exemplary expansion apparatus is particularly suited to expanding complete lengths of hollow tubular casing by reason of the conically disposed leading set of rollers opening up previously unexpended casing and the following set of cylindrically disposed rollers finish-expanding the casing to its intended final diameter; if this exemplary expansion apparatus were modified by the addition of a further set of rollers conforming to third regime with non-convergent axes, this further set of rollers could be utilized for the purpose of applying traction forces to the apparatus by means of the principles described in the present inventor's previously published PACT patent application W/24728-A, the concerns of which are incorporated herein by reference.

The rollers of said expansion apparatus may each be mounted for rotation about its respective rotation axis substantially without freedom of movement along its respective rotation axis, or the rollers may each be mounted for rotation about its respective rotation axis with freedom of movement along its respective rotation axis, preferably within predetermined limits of movement. In the latter case (freedom of along-axis movement within predetermined limits), this is advantageous in the particular case of rollers conforming to the adore-mentioned second regime (i.e. a conical array of rollers) in that the effective maximum outside diameter of the rollers depends on the position of the rollers along the axis of the expansion apparatus and this diameter is thereby effectively variable; this allows relief of radially outwardly directed forces by longitudinally retracting the expansion apparatus to allow the rollers collectively to move longitudinally in the convergent direction and hence collectively to retract radially inwards away from the bore against which they were immediately previously pressing.

According to a fourth aspect of the present invention, there is provided profiling/conjoining apparatus for profiling or conjoining pipes or other hollow tubular articles, said profiling/conjoining apparatus comprising roller means and radial urging means selectively operable to urge the roller means radially outwards of a longitudinal axis of the profiling/conjoining apparatus, the radial urging means causing or allowing the roller means to move radially inwards towards the longitudinal axis of the profiling/conjoining apparatus when the radial urging means is not operated, the roller means comprising a plurality of individual rollers each mounted for rotation about a respective rotation axis which is substantially parallel to the longitudinal axis of the profiling/conjoining apparatus, the rotation axes of the individual rollers being circumferentially distributed around the apparatus and each said rotation axis being radially offset from the longitudinal axis of the profiling/conjoining apparatus, the profiling/conjoining apparatus being selectively rotatable around its longitudinal axis to translate the roller means across the bore of a pipe against which the roller means is being radially urged.

The radial urging means may comprise a respective piston on which each said roller is individually rotatably mounted, each said piston being slidably sealed in a respective radially extending bore formed in a body of the profiling/conjoining apparatus, a radially inner end of each said bore being in fluid communication with fluid pressure supply means selectively pressurizable to operate said radial urging means.

Alternatively, the radial urging means may comprise bi-conical race means upon which each said individual roller rolls in use of the profiling/conjoining apparatus, and separation variation means selectively operable controllably to vary the longitudinal separation of the two conical races of the bi-conical race means whereby correspondingly to vary the radial displacement of each said roller rotation axis from the longitudinal axis of the profiling/conjoining apparatus. The separation variation means may comprise hydraulic linear motor means selectively pressurizable to drive one of said two cones longitudinally towards and/or away from the other said cone.

BRIEF DESCRIPTION OF THE SEVERAL VIEWS OF THE DRAWINGS

Embodiments of the invention will now be described by way of example, with reference to the accompanying drawings wherein:

FIGS. 7A & 78 are illustrations corresponding to FIGS. 5A & 5B but in respect of a variant of the FIGS. 1–4 profiling tool having two rollers instead of three;

DETAILED DESCRIPTION OF THE PREFERRED EMBODIMENTS OF THE INVENTION

Figure 1:
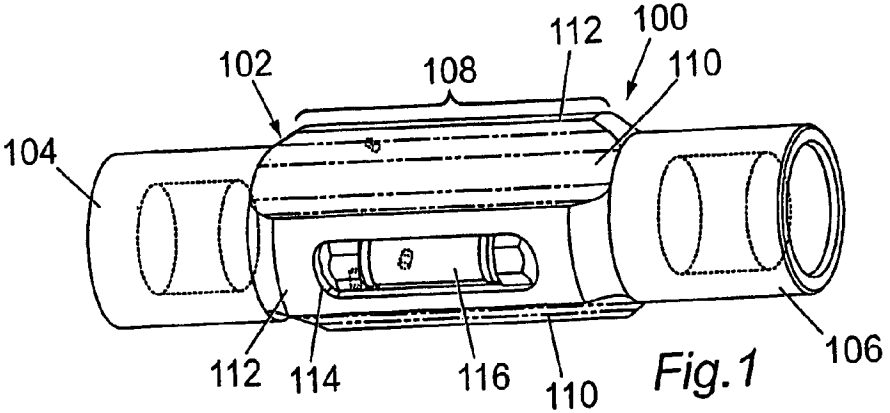
FIG. 1 is a plan view of a first embodiment of profiling tool.
Figure 2:
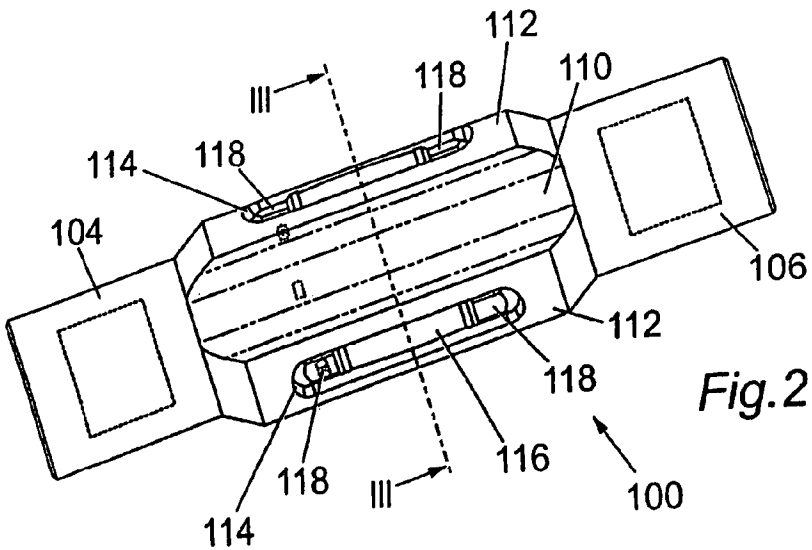
FIG. 2 is an elevation of the profiling tool of FIG. 1.
Figure 3:
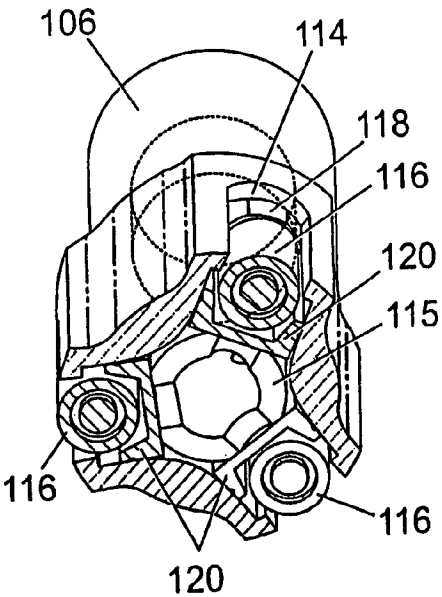
FIG. 3 is a sectional perspective view of the profiling tool of FIGS. 1 & 2, the section being taken on the line III—III in FIG. 2.

Referring first to FIGS. 1 & 2, these depict a three-roller profiling tool 100 in accordance with the present invention. The tool 100 has a body 102 which is hollow and generally tubular, with conventional screw-threaded end connectors 104 & 106 for connection to other components (not shown) of a downhole assembly. The end connectors 104 & 106 are of reduced diameter (compared to the outside diameter of the longitudinally central body part 108 of the tool 100), and together with three longitudinal flutes 110 on the central body part 108, allow the passage of fluids along the outside of the tool 100. The central body part 108 has three lands 112 defined between the three flutes 110, each land 112 being formed with a respective recess 114 to hold a respective roller 116 (see also FIGS. 3 & 4). Each of the recesses 114 has parallel sides and extends radially from the radially perforated tubular core 115 of the tool 100 to the exterior of the respective land 112. Each of the mutually identical rollers 116 is near-cylindrical and slightly barreled (i.e. of slightly greater diameter in its longitudinally central region than at either longitudinal end, with a generally convex profile having a discontinuity-free transition between greatest and least diameters). Each of the rollers 116 is mounted by means of a bearing 118 at each end of the respective roller for rotation about a respective rotation axis which is parallel to the longitudinal axis of the tool 100 and radially offset therefrom at 120-degree mutual circumferential separations around the central part 108. The bearings 118 are formed as integral end members of radially slidable pistons 120, one piston 120 being slidably sealed within each radially extending recess 114. The inner end of each piston 120 is exposed to the pressure of fluid within the hollow core of the tool 100 by way of the radial perforations in the tubular core 115; in use of the tool 100, this fluid pressure will be the downhole pressure of mud or other liquid within a drillstring or coiled tubing at or near the lower end of which the toll 100 will be mounted. Thus, by suitably pressurizing the core 115 of the tool 100, the pistons 120 can be driven radially outwards with a controllable force which is proportional to the pressurization, and thereby the piston-mounted rollers 116 can be forged against a pipe bore in a manner to be detailed below. Conversely, when the pressurization of the core 115 of the tool 100 is reduced to below whatever is the ambient pressure immediately outside the tool 100, the pistons 120 (together with the piston-mounted rollers 116) are allowed to retract radially back into their respective recesses 114. (Such retraction can optionally be encouraged by suitably disposed springs (not shown)).

Figure 6:
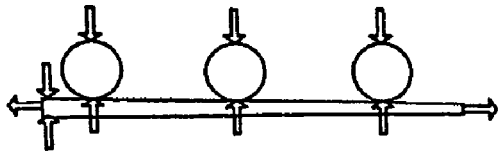
FIG. 6 is a schematic diagram illustrating the metallurgical principle underlying the operational stage depicted in FIG. 5C.

The principles by which the profiling tool 100 functions will now be detailed with reference to FIGS. 5 and 6.

Figure 5A:
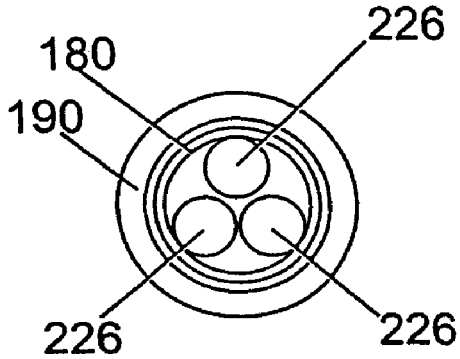
FIGS. 5A, 5B, & 5C are simplified sectional views of three successive stages of operation of the profiling tool of FIGS. 1–4.

FIG. 5A is a schematic end view of the three rollers 116 within the bore of an inner pipe 180, the remainder of the tool 100 being omitted for the sake of clarity. The pipe 180 is nested within an outer pipe 190 whose internal diameter is somewhat greater than the outside diameter of the inner pipe 180. As depicted in FIG. 5A, the core of the tool 100 has been pressurized just sufficiently to push the pistons 120 radially outwards and thereby to bring the piston-mounted rollers 116 into contact with the bore of the inner pipe 180, but without at first exerting any significant forces on the pipe 180.

Figure 5B:
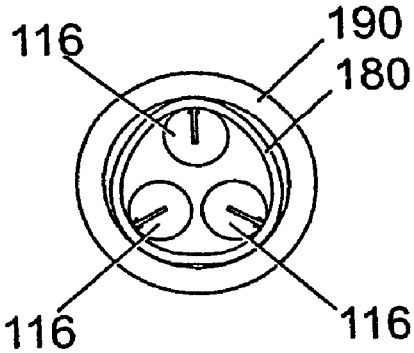
Figure 5C:
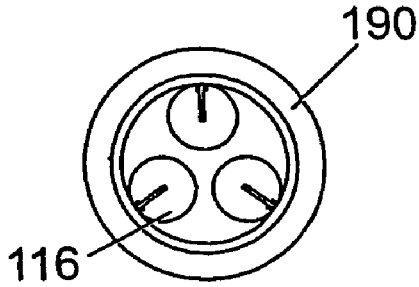

FIG. 5B depicts the next stage of operation of the profiling tool 100, in which the internal pressurization of the tool 100 is increased sufficiently above its external pressure (i.e. the pressure in the region between the exterior of the tool 100 and the bore of the pipe 180) such that the rollers 116 each exert a substantial outward force, as denoted by the arrow-headed vectors superimposed on each roller 116 in FIG. 5B. The effect of such outward forces on the rollers 116 is circumferentially to deform the wall of the inner pipe 180 (with concomitant distortion of the pipe 180 which is shown in FIG. 5B for the sake of clarity). When the roller-extended lobes touch the bore of the outer pipe 190, the inner pipe 180 is thereby anchored against rotation with respect to the outer pipe 190, or at least constrained against free relative rotation. By simultaneously rotating the tool 100 around its longitudinal axis (which will normally be substantially coincident with the longitudinal axis of the pipe 180), the circumferential deformation of the wall of the pipe 180 tends to become uniform around the pipe 180, and the pipe 180 circumferentially extends into substantially uniform contact with the bore of the outer pipe 190, as depicted in FIG. 5C. This occurs due to the rollers causing rolling compressive yield of the inner pipe wall to cause reduction in wall thickness, increase in circumference and consequent increase in diameter. (Rotation of the tool 100 can be undertaken by any suitable procedure, several of which will subsequently be described). Circumferential deformation of the pipe 180 is initially elastic and may subsequently be plastic. A secondary effect of the process is to generate compressive hoop stress in the internal portion of the inner tube and an interference fit between the inner tube and the outer tube.

From the stage depicted in FIG. 5C wherein the inner pipe 180 has initially been circumferentially deformed just into full contact with the bore of the outer pipe 190 (thus removing the previous clearance between the pipes 180 and 190) but without stretching or distortion of the outer pipe 190, continued (and possibly increased) internal pressurization of the tool 100 in conjunction with continued rotation of the tool 100 (at the same rotational speed or at a suitably different rotational speed) forces the inner pipe 180 outwards against the resistance to deformation of the outer pipe 190. Since the inner pipe 180 is now backed by the outer pipe 190 with respect to the radially outward forces being applied by the rollers 116 such that the wall of the inner pipe 180 is now pinched between the rollers 116 and the outer pipe 190, the mechanism of deformation of the pipe 180 changes to compressive extension by rolling (i.e. the same thinning/extension principle as prevails in conventional steel rolling mills, as schematically depicted in FIG. 6 wherein the circular rolling of FIGS. 5A–5C has been opened out and developed into an equivalent straight-line rolling procedure to enhance the analogy with steel rolling mills).

When operation of the tool 100 is terminated and the rollers 116 are caused or allowed to retract radially into the body of the tool 100 thereby to relieve the pipes 180 of all contact with the rollers 116, the induced compressive hoop stress created in the wall of the inner pipe 180 due to the rolling process causes the inner pipe 180 to remain in contact with the inner wall of the outer pipe 190 with very high contact stresses at their interface.

Figure 7A:
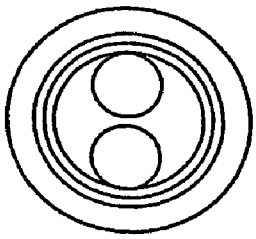
Figure 7B:
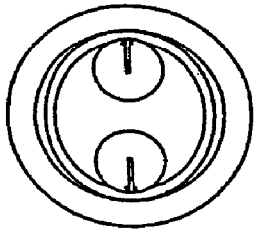

FIGS. 7A & 7B correspond to FIGS. 5A & 5B, and schematically depict the equivalent stages of operation of a two-roller profiling tool (not otherwise shown per se) in order to illustrate the effects of using a profiling tool having fewer than the three rollers of the profiling tool 100 detailed above.

Figure 8A:
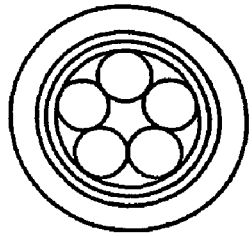
FIGS. 8A & 8B are illustrations corresponding to FIGS. 5A & 5B but in respect of a variant of the FIGS. 1–4 profiling tool having five rollers instead of three.
Figure 8B:
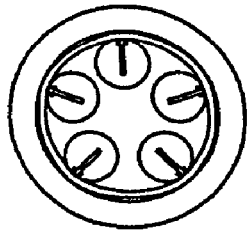

FIGS. 8A & 8B also correspond to FIGS. 5A & 5B, and schematically depict the equivalent stages of operation of a five-roller profiling tool (not otherwise shown per se) in order to illustrate the effects or using a profiling tool having more than the three rollers of the profiling tool 100 detailed above.

It should be noted that though the very high contact stresses existing at the interface of the inner pipe 180 and outer pipe 190 may cause the outer pipe 190 to expand elastically or plastically, it is not a requirement of this process that the outer pipe 190 is capable of any expansion whatsoever. The process would still result in the high contact stresses between the inner pipe 180 and the outer pipe 190 even if the outer pipe 190 was incapable of expansion, e.g. by being thick walled, by being encased in cement, or being tightly embedded in a rock formation.

Various practical applications of profiling tools in accordance with the invention will now be described with reference to FIGS. 9–19, the profiling tool used in these practical applications may be the profiling tool 100 detailed above, or some variant of such a profiling tool which differs in one or more details without departing from the scope of the invention.

Figure 9A:
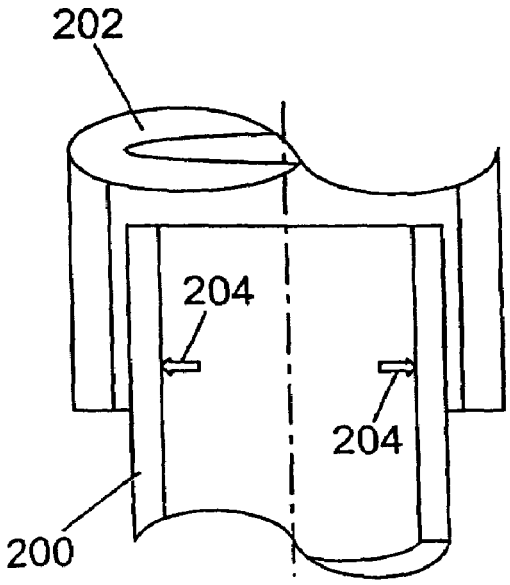
FIGS. 9A & 9B respectively illustrate starting and finishing stages of a first practical application of the profiling tool of FIGS. 1–4.

FIG. 9A schematically depicts the upper end of a first pipe or casing 200 concentrically nested within the lower end of a second pipe or casing 202 whose bore (internal diameter) is marginally greater than the outside diameter of the first pipe or casing 200. A profiling tool (not shown) is located within the upper end of the first pipe or casing 200 where it is overlapped by the second pipe or casing 202. The rollers of the profiling tool are then radially extended into contact with the bore of the inner pipe or casing 200 by means of internal pressurization of the profiling tool (or by any other suitable means which may alternatively be utilized for forcing the rollers radially outwards of the profiling tool). The outward forces exerted by the rollers on the bore of the first pipe or casing 200 are schematically depicted by the force-vector-depicting arrows 204.

Figure 9B:
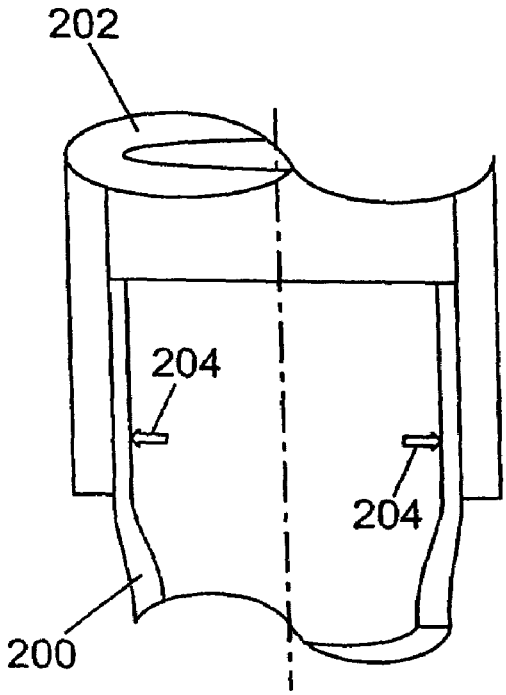

From the starting situation depicted in FIG. 9A, combined with suitable rotation of the profiling tool about its longitudinal axis (which is substantially coincident with the longitudinal axis of the first pipe or casing 200), the finish situation schematically depicted in FIG. 9B is arrived at, namely the upper end of the inner pipe or casing 200 is profiled by permanent plastic expansion into conjunction with the lower end of the second pipe or casing 202. Thereby the two pipes or casings are permanently conjoined without the use of any form of separate connector and without the use of conventional joining techniques such as welding.

Figure 10A:
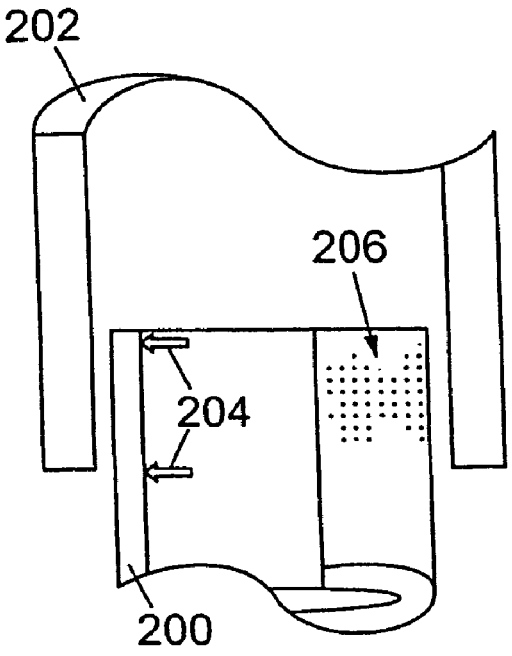
FIGS. 10A & 10B respectively illustrate starting and finishing stages of a second practical application of the profiling tool of FIGS. 1–4.
Figure 10B:
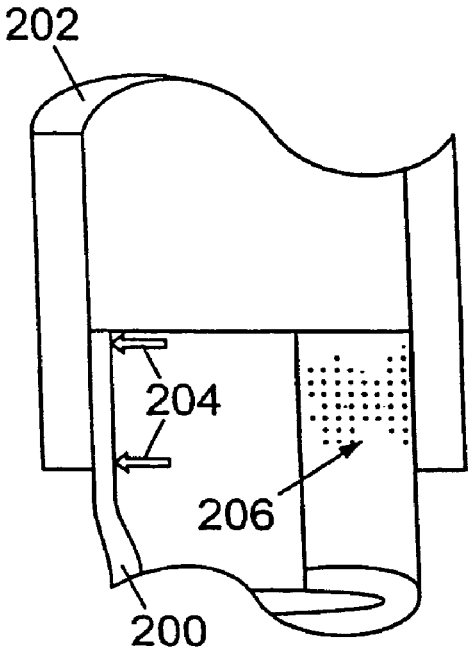

FIGS. 10A & 10B correspond to FIGS. 9A & 9B respectively, and schematically illustrate an optional modification of the profiling/conjoining technique described with respect to FIGS. 9A & 9B. The modification consists of applying an adherent coating 206 of hard particulate material to the exterior of the upper end of the first (inner) pipe or casing 200 prior to its location within the lower end of the second (outer) pipe or casing 202. The hard particulate material may consist of carbide granules, e.g. tungsten carbide granules such as are commonly used to coat downhole reamers. In the application depicted in FIGS. 10A & 10B, the hard particulate material is selected for its crush resistance rather than for its abrasive qualities, and in particular the material is selected for its ability to interpenetrate the meeting surfaces of two sheets of steel which are pressed together with the hard particulate material sandwiched between the steel components. Such sandwiching is schematically depicted in FIG. 10B. Tests have shown a surprising increase in resistance to separation forces of pipes or other articles conjoined by a profiling tool in accordance with the invention to withstand, where a coating of hard particulate material was first interposed between the parts being conjoined. It is preferred that of the whole area to be coated, only a majority of the area is actually covered with the particulate material, e.g. 10% of the area. (It is believed that a higher covering factor actually reduces the interpenetration effect and hence diminishes the benefits below the optimum level).

Figure 11A:
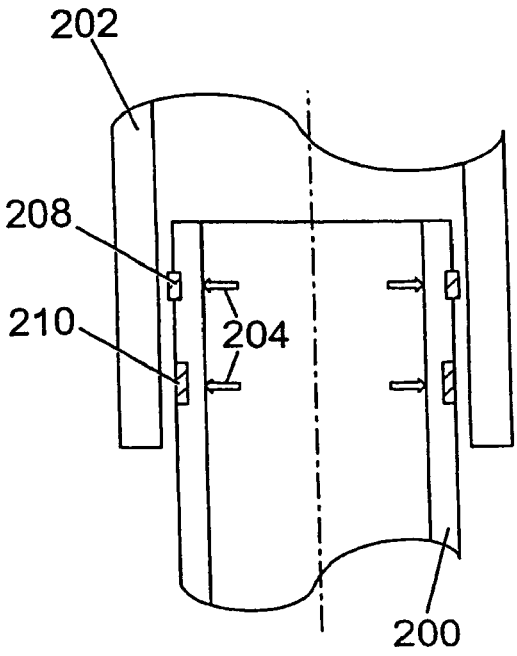
FIGS. 11A & 11B respectively illustrate starting and finishing stages of a third practical application of the profiling tool of FIGS. 1–4.
Figure 11B:
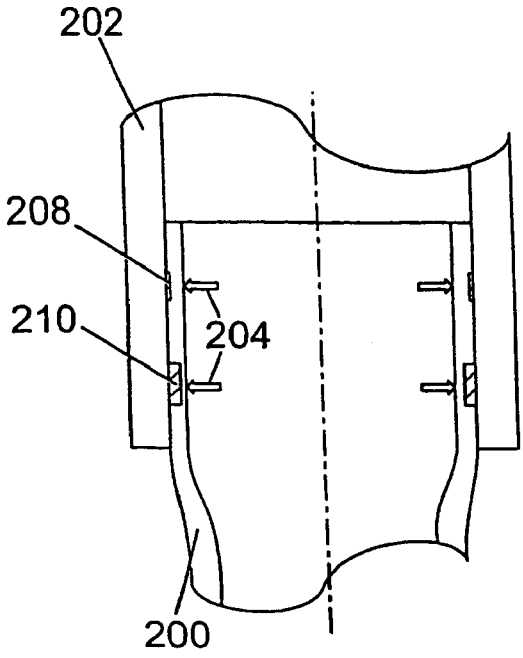

Referring now to FIGS. 11A & 11B, these schematically depict an optional modification of the FIG. 9 conjoining procedure to achieve improved sealing between the two conjoined pipes or casings. As depicted in FIG. 11A, the modification comprises initially fitting the exterior of the first (inner) pipe or casing 200 with a circumferentially extending and part-recessed ductile metal ring 208, which may (for example) be formed of a suitable copper alloy or a suitable tin/lead alloy. The modification also comprises initially fitting the exterior of the first (inner) pipe or casing 200 with a circumferentially extending and fully recessed elastomeric ring 210. As depicted in FIG. 11B, the rings 208 and 210 become crushed between the two pipes or casings 200 & 202 after these have been conjoined by the profiling tool, and thereby a mutual sealing is achieved which may be expected to be superior to the basic FIG. 9 arrangement in otherwise equal circumstances. In suitable situations, one or other of the sealing rings 208 and 210 may be omitted or multiplied to achieve a necessary or desirable level of sealing (e.g. as in FIG. 12).

Figure 12A:
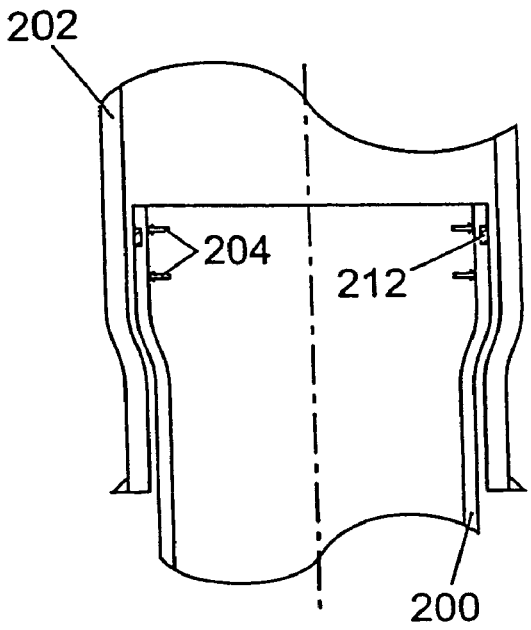
FIGS. 12A & 12B respectively illustrate starting and finishing stages of a fourth practical application of the profiling tool of FIGS. 1–4.
Figure 12B:
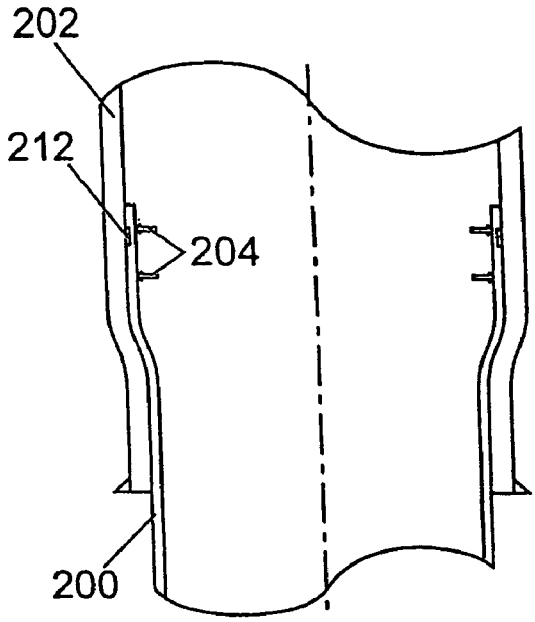

Referring now to FIGS. 12A & 12B, these schematically depict an arrangement in which the lower end of the second (outer) casing 202 is pre-formed to have a reduced diameter so as to function as a casing hanger. The upper end of the first (inner) casing 200 is correspondingly pre-formed to have an increased diameter which is complementary to the reduced diameter of the casing hanger formed at the lower end of the outer casing 202, as depicted in FIG. 12A. Optionally, the upper end of the first (inner) casing 200 may be provided with an external seal in the form of an elastomeric ring 212 flush-mounted in a circumferential groove formed in the outer surface of the first casing 200. The arrangement of FIG. 12A differs from the arrangement of FIG. 9A in that the latter arrangement requires the pipe or casing 200 to be positively held up (to avoid dropping down the well our of its intended position) until joined to the upper pipe or casing as in FIG. 9B, whereas in the FIG. 12A arrangement the casing hanger allows the inner/lower casing 200 to be lowered into position and then released without the possibility of dropping out of position prior to the two casings being conjoined by the profiling tool, as depicted in FIG. 12B.

Figure 13A:
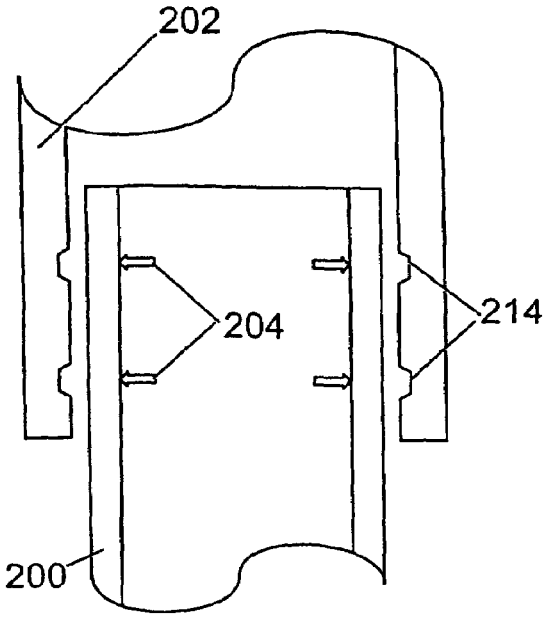
FIGS. 13A & 13B respectively illustrate starting and finishing stages of a fifth practical application of the profiling tool of FIGS. 1–4.
Figure 13B:
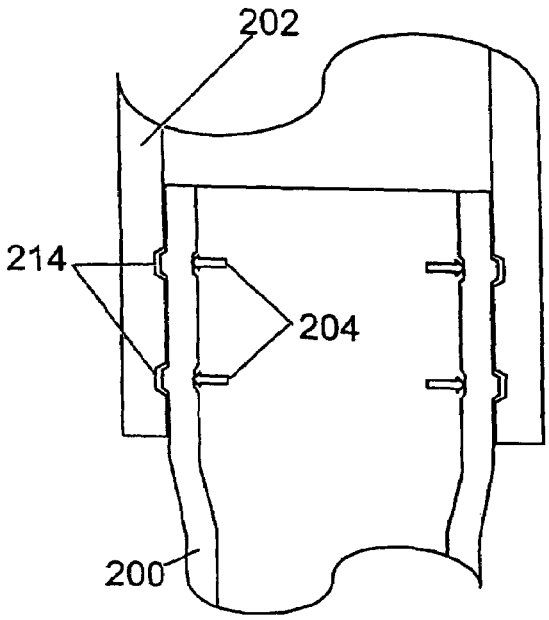

Referring now to FIGS. 13A & 13B, these schematically depict another optional modification of the FIG. 9 conjoining procedure in order to achieve a superior resistance to post-conjunction separation. As depicted in FIG. 13A, the modification consists of initially forming the bore (inner surface) of the second (outer) pipe or casing 202 with two circumferentially extending grooves 214 each having a width which reduces with increasing depth. As depicted in FIG. 13B, when the two pipes or casings 200 and 202 have been conjoined by the profiling tool (as detailed with respect to FIGS. 9A & 9B), the first (inner) pipe or casing 200 will have been plastically deformed into the grooves 214, thereby increasing the interlocking of the conjoined pipes or casings and extending their resistance to post-conjunction separation. While two grooves 214 are shown in FIGS. 13A & 13B by way of example, this procedure can in suitable circumstances be carried with one such groove, or with three or more such grooves. While each of the grooves 214 has been shown with a preferred trapezoidal cross-section, other suitable groove cross-sections can be substituted.

Figure 14A:
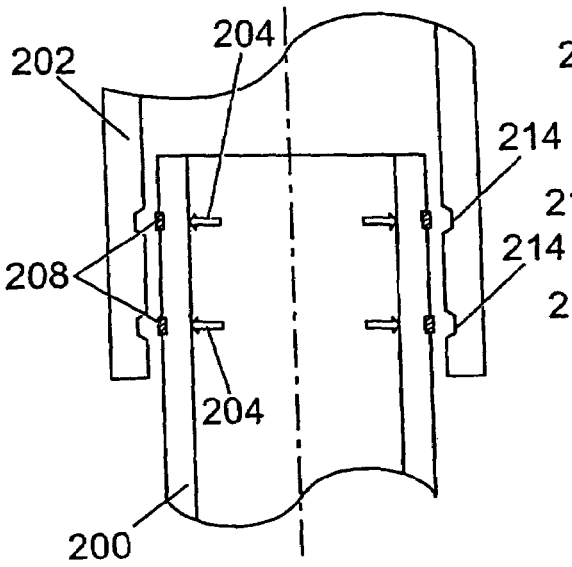
FIGS. 14A & 14B respectively illustrate starting and finishing stages of a sixth practical application of the profiling tool of FIGS. 1–4.
Figure 14B:
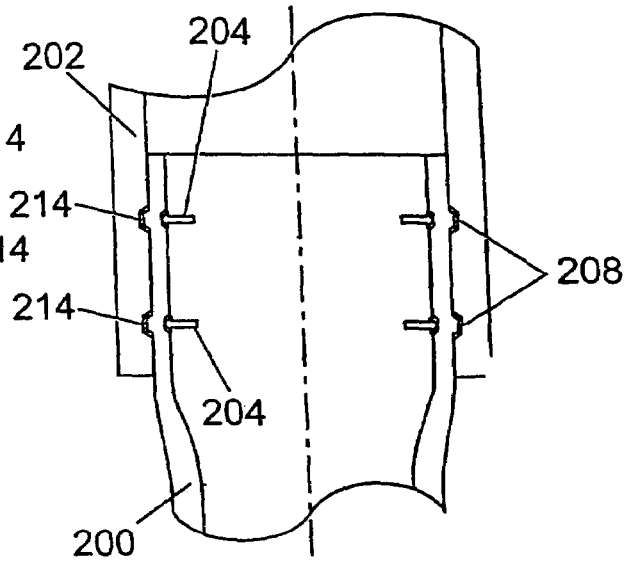

The superior joint strength of the FIG. 13 arrangement can be combined with the superior sealing function of the FIG. 11 arrangement, as shown in FIG. 14. FIG. 14A schematically depicts the pre-jointing configuration, in which the exterior of the first (inner) pipe or casing 200 is fitted with a longitudinally spaced pair of circumferentially extending and part-recessed ductile metal rings 208, while the bore (inner surface) of the second (outer) pipe or casing 202 is formed with two circumferentially extending grooves 214 each having a width which reduces with increasing depth. The longitudinal spacing of the two grooves 214 is substantially the same as the longitudinal spacing of the seal rings 208. When the two pipes or casings are conjoined by use of the profiling tool (as schematically depicted in FIG. 14B), the first (inner) pipe or casing 200 is not only plastically deformed into the corresponding grooves 214 (as in FIG. 13B), but the metal rings 208 are crushed into the bottoms of these grooves 214 thereby to form high grade metal-to-metal seals.

Figure 15A:
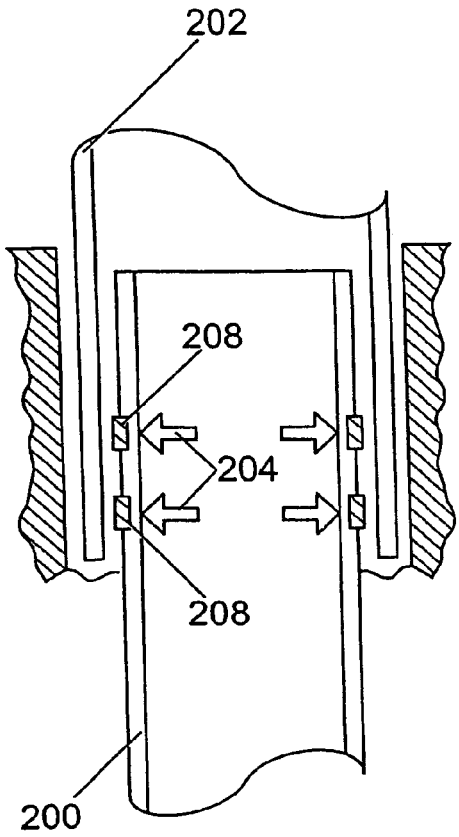
FIGS. 15A & 15B respectively illustrate starting and finishing stages of a seventh practical application of the profiling tool of FIGS. 1–4.
Figure 15B:
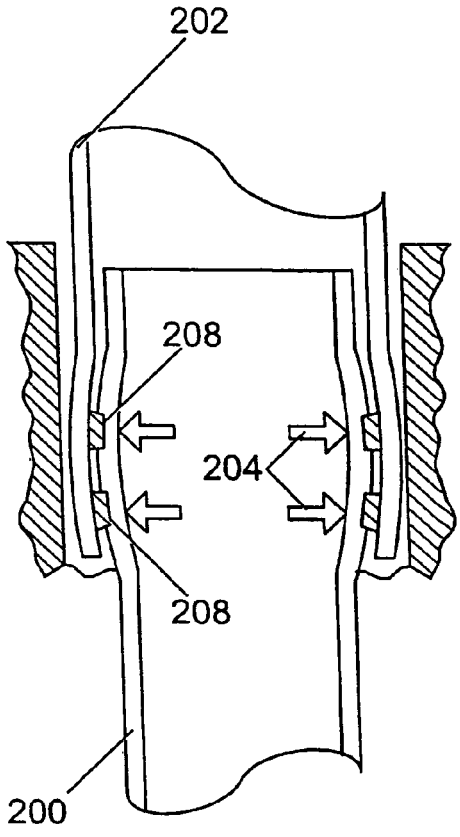

In the arrangements of FIGS. 9–14, it is assumed that the second (outer) pipe or casing 202 undergoes little or no permanent deformation, which may either be due to the outer pipe or casing 202 being inherently rigid compared to the first (inner) pipe or casing 200, or be due to the outer pipe or casing being rigidly backed (e.g. by cured concrete filling the annulus around the outer pipe or casing 202), or be due to a combination of these and/or other reasons. FIG. 15 schematically depicts an alternative situation in which the second (outer) pipe or casing 202 does not have the previously assumed rigidity. As schematically depicted in FIG. 15A, the pre-jointing configuration is merely a variant of the previously described pipe-joining arrangements, in which the exterior of the upper end of the first (inner) pipe or casing 200 is provided with two part-recessed metal seal rings 208 (each mounted in a respective circumferential groove), neither pipe being otherwise modified from its initial plain tubular shape. To conjoin the casings 200 and 202, the profiling tool is operated in a manner which forces the second (outer) casing 202 through its elastic limit and into a region of plastic deformation, such that when the conjoining process is completed, both casings retain a permanent outward set as depicted in FIG. 15B.

In each of the arrangements described with reference to FIGS. 9–15, the bore of the first pipe or casing 200 was generally smaller than the bore of the second pipe or casing 202. However, there are situations where it would be necessary or desirable that these bores be about mutually equal following conjoining, and this requires variation of the previously described arrangements, as will now be detailed.

Figure 16A:
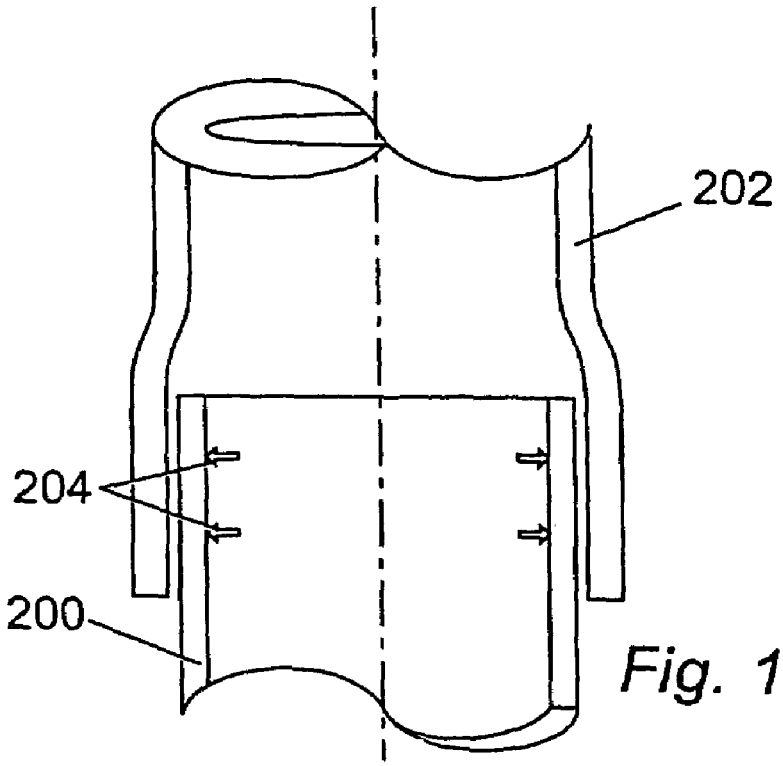
FIGS. 16A & 16B respectively depict starting and finishing stages of an eighth practical application of the profiling tool of FIGS. 1–4.
Figure 16B:
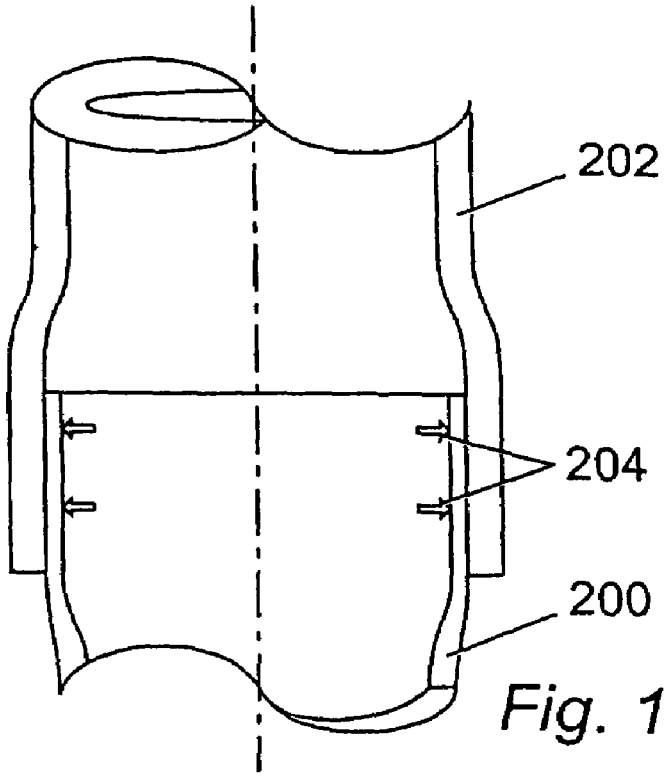

In the arrangement schematically depicted in FIG. 16A, the lower end of the second (outer) pipe or casing 202 is pre-formed to have an enlarged diameter, the bore (inside diameter) of this enlarged end being marginally greater than the outside diameter of the first (inner) pipe or casing 200 intended to be conjoined thereto. The first (inner) pipe or casing 200 has initial dimensions which are similar or identical to those of the second pipe or casing 202 (ocher than for the enlarged end of the pipe or casing 202). Following use of the profiling tool to expand the overlapping ends of the two pipes or casings, both bores have about the same diameter (as depicted in FIG. 16B) which has certain advantages (e.g. a certain minimum bore at depth in a well no longer requires a larger or much larger bore at lesser depth in the well). While surface-level pipes can be extended in this manner without difficulties in adding extra lengths of pipe, special techniques may be necessary for feeding successive lengths of casing to downhole locations when extending casing in a downhole direction. (One possible solution to this requirement may be provide successive lengths of casing with a reduced diameter, and to expand the entire length of each successive length of casing to the uniform bore of previously installed casing, this being achievable by further aspects of the invention to be subsequently described by way of example with reference to FIG. 20 et seq).

Figure 17A:
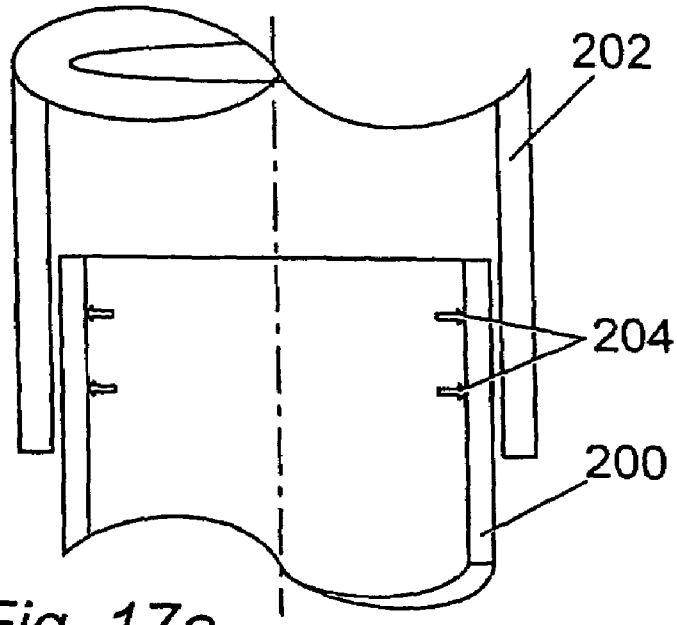
FIGS. 17A & 17B respectively depict starting and finishing stages of a ninth practical application of the profiling tool of FIGS. 1–4.
Figure 17B:
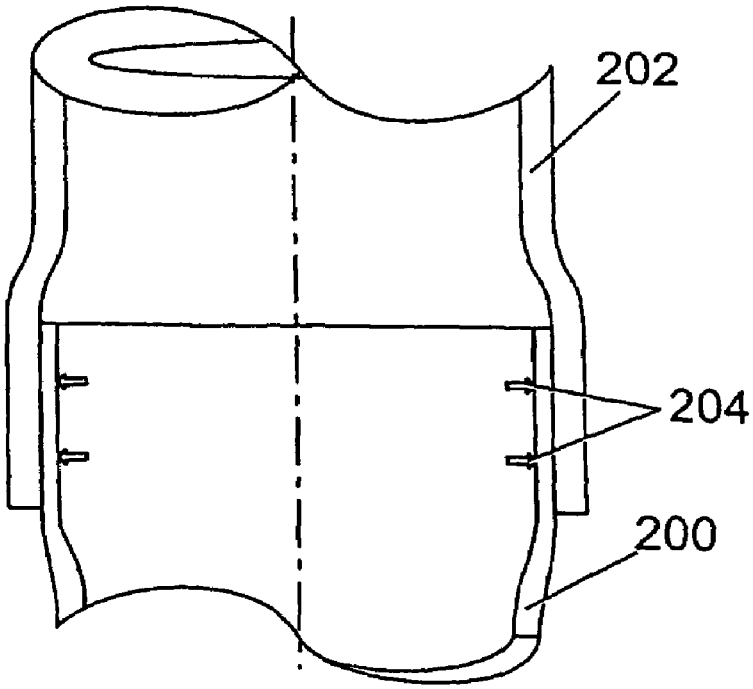

A modification of the procedure and arrangement of FIG. 16 is schematically depicted in FIG. 17 wherein the end of the outer pipe or casing is not pre-formed to an enlarged diameter (FIG. 17A). It is assumed in this case that the profiling tool is capable of exerting sufficient outward force through its rollers as to be capable of sufficiently extending the diameter of the outer pipe or casing simultaneously with the diametral extension of the inner pipe or casing during forming of the joint (FIG. 17B).

As well as conjoining pipes or casings, the profiling tool in accordance with the invention can be utilized for other useful purposes such as will now be detailed with reference to FIGS. 18 and 19.

Figure 18:
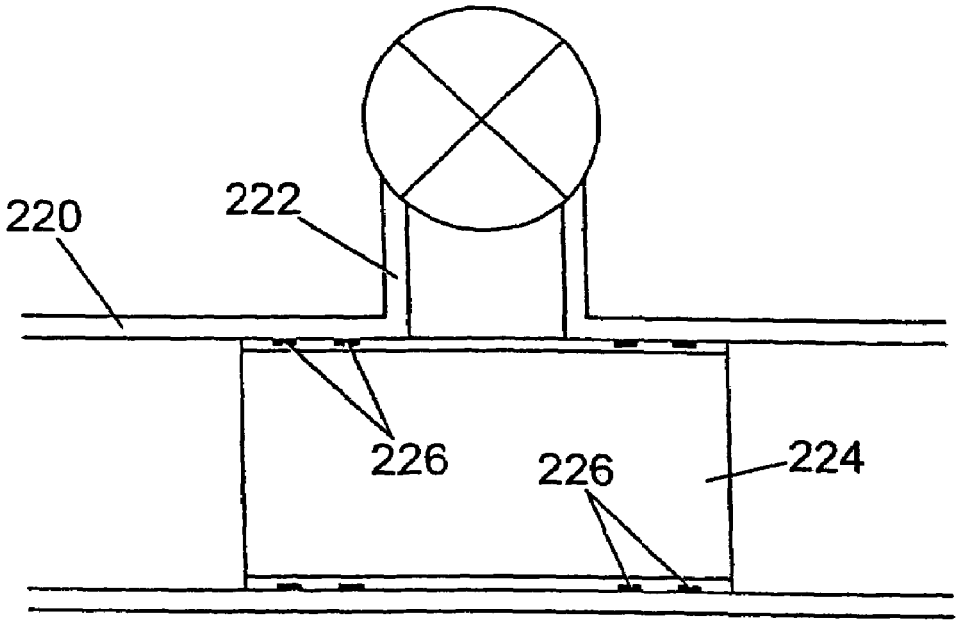
FIG. 18 schematically depicts a tenth practical application of the profiling tool of FIGS. 1–4.

In the situation schematically depicted in FIG. 18, a riser 220 has a branch 222 which is to be blocked off while continuing to allow free flow of fluid along the riser 220. To meet this requirement, a sleeve 224 is placed within the riser 220 in position to bridge the branch 222. The sleeve 224 initially has an external diameter which is just sufficiently less than the internal diameter of the riser 220 as to allow the sleeve 224 to be passed along the riser to its required location. Each end of the sleeve 224 is provided with external seals 226 of any suitable form, e.g. the seals described with reference to FIG. 11. When the sleeve 224 is correctly located across the branch 222, a profiling tool (not shown in FIG. 18) is applied to each end of the sleeve 224 to expand the sleeve ends into mechanically anchoring and fluid-sealing contact with the bore of the riser 220, thus permanently sealing the branch (until such time as the sleeve may be milled away or a window may be cut through it).

Figure 19:
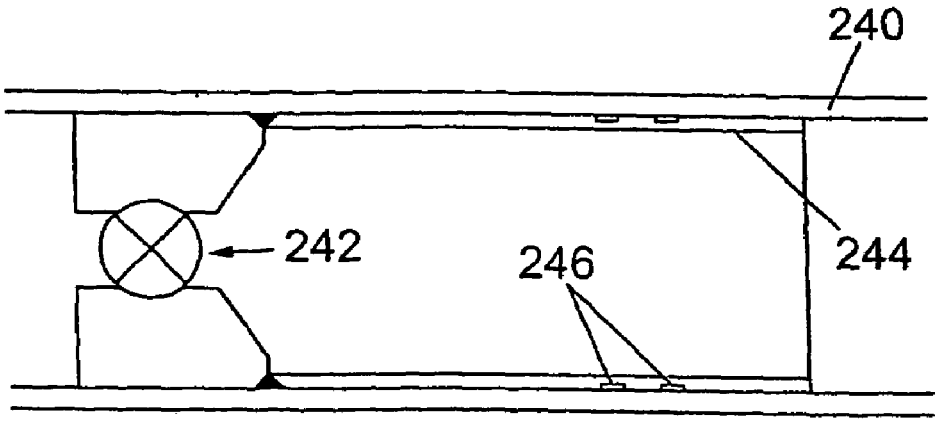
FIG. 19 schematically depicts an eleventh practical application of the profiling tool of FIGS. 1–4.

FIG. 19 schematically depicts another alternative use of the profiling tool in accordance with the invention, in which a valve requires to be installed within plain pipe or casing 240 (i.e. pipe or casing free of landing nipples or other means of locating and anchoring downhole equipment). A valve 242 of a size to fit within the pipe or casing 240 has a hollow tubular sleeve 244 welded or otherwise secured to one end of the valve. The sleeve 244 initially has an external diameter which is just sufficiently less than the internal diameter of the pipe or casing 240 as to allow the mutually attached valve 242 and sleeve 244 to passed down the pipe or casing 240 to the required location. The end of the sleeve 244 opposite to the end attached to the valve 242 is provided with external seals 246 of any suitable form, e.g. the seals described with reference to FIG. 11. When the valve 242 is correctly located where it is intended to be installed, a profiling tool (not shown in FIG. 19) is applied to the end of the sleeve opposite the valve 242 to expand that end of the sleeve 244 into mechanically anchoring and fluid-sealing contact with the bore of the pipe or casing 240. An optional modification of the FIG. 19 arrangement is to attach an expandable sleeve to both sides of the valve such that the valve can be anchored and sealed on either side instead of one side only as in FIG. 19.

Figure 20:
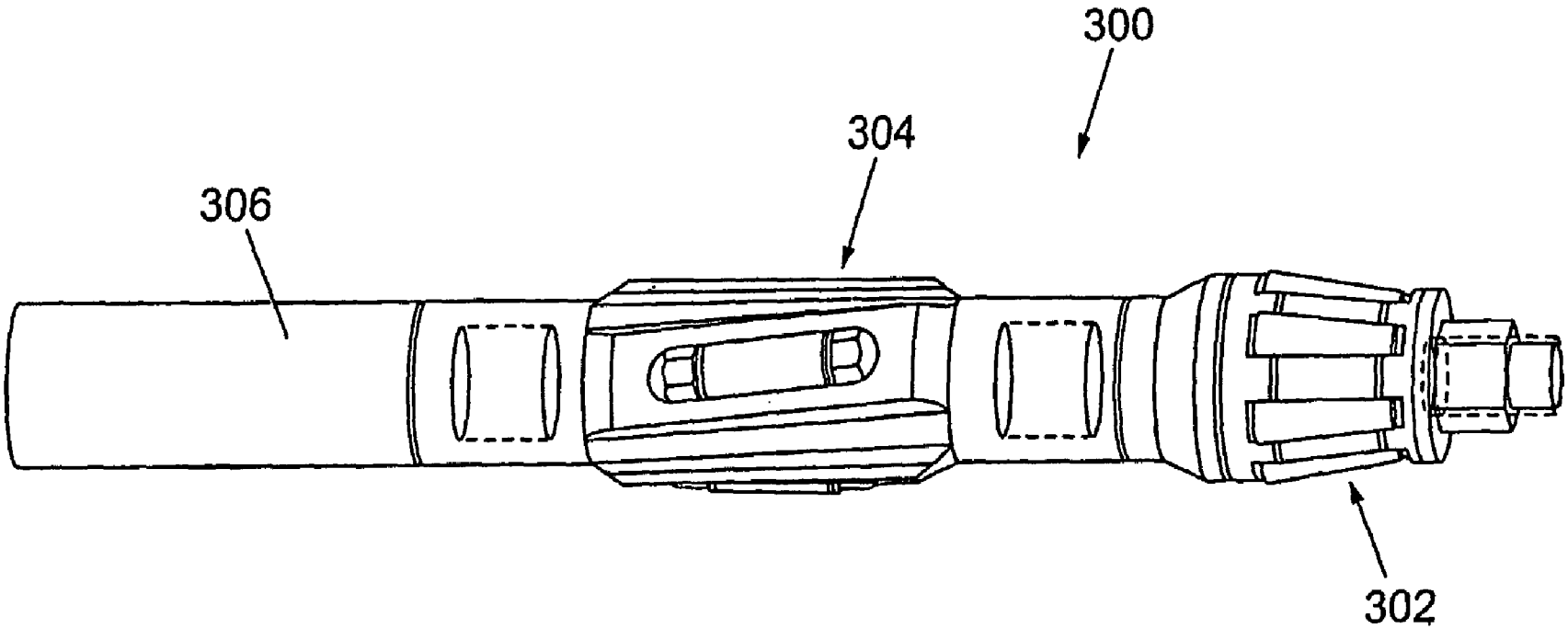
FIG. 20 is a longitudinal elevation of a first embodiment of expansion tool in accordance with the present invention.

Turning now to FIG. 20, this illustrates a side elevation of an embodiment of expansion tool 300 in accordance with the present invention. The expansion tool 300 is an assembly of a primary expansion tool 302 and a secondary expansion tool 304, together with a connector sub 306 which is not essential to the invention but which facilitates mechanical and hydraulic coupling of the expansion tool 300 to the downhole end of a drillstring (not shown) or to the downhole end of coiled tubing (not shown). The primary expansion tool 302 is shown separately and to an enlarged scale in FIG. 21 (and again, in exploded view, in FIG. 21A). The expansion tool 300 is shown in longitudinal section in FIG. 22, the primary expansion tool 302 is shown separately in longitudinal section in FIG. 23, and the secondary expansion tool 304 is shown separately in an exploded view in FIG. 24.

Figure 21:
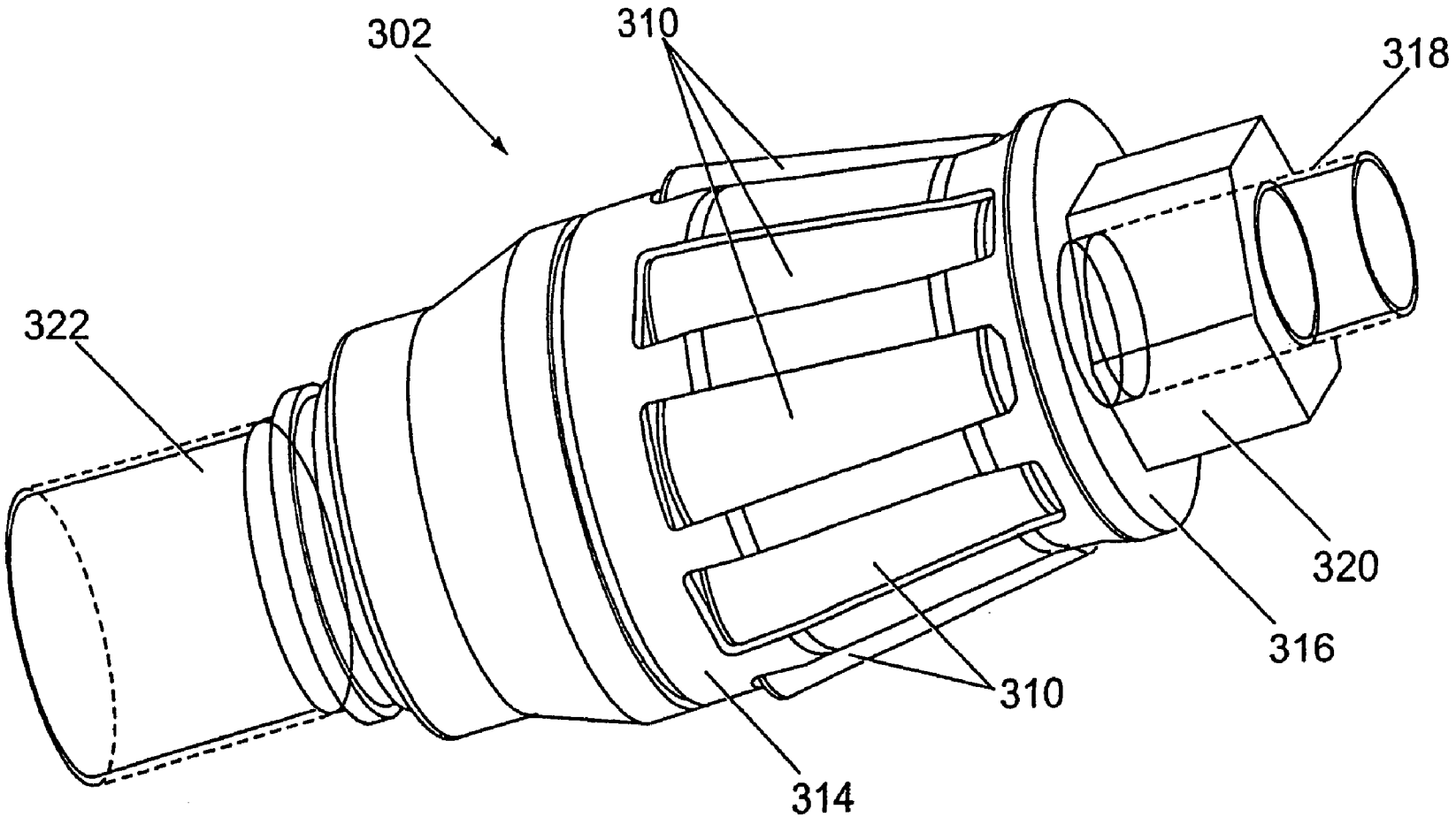
FIG. 21 is a longitudinal elevation, to an enlarged scale, of part of the expansion tool of FIG. 20.
Figure 21A:
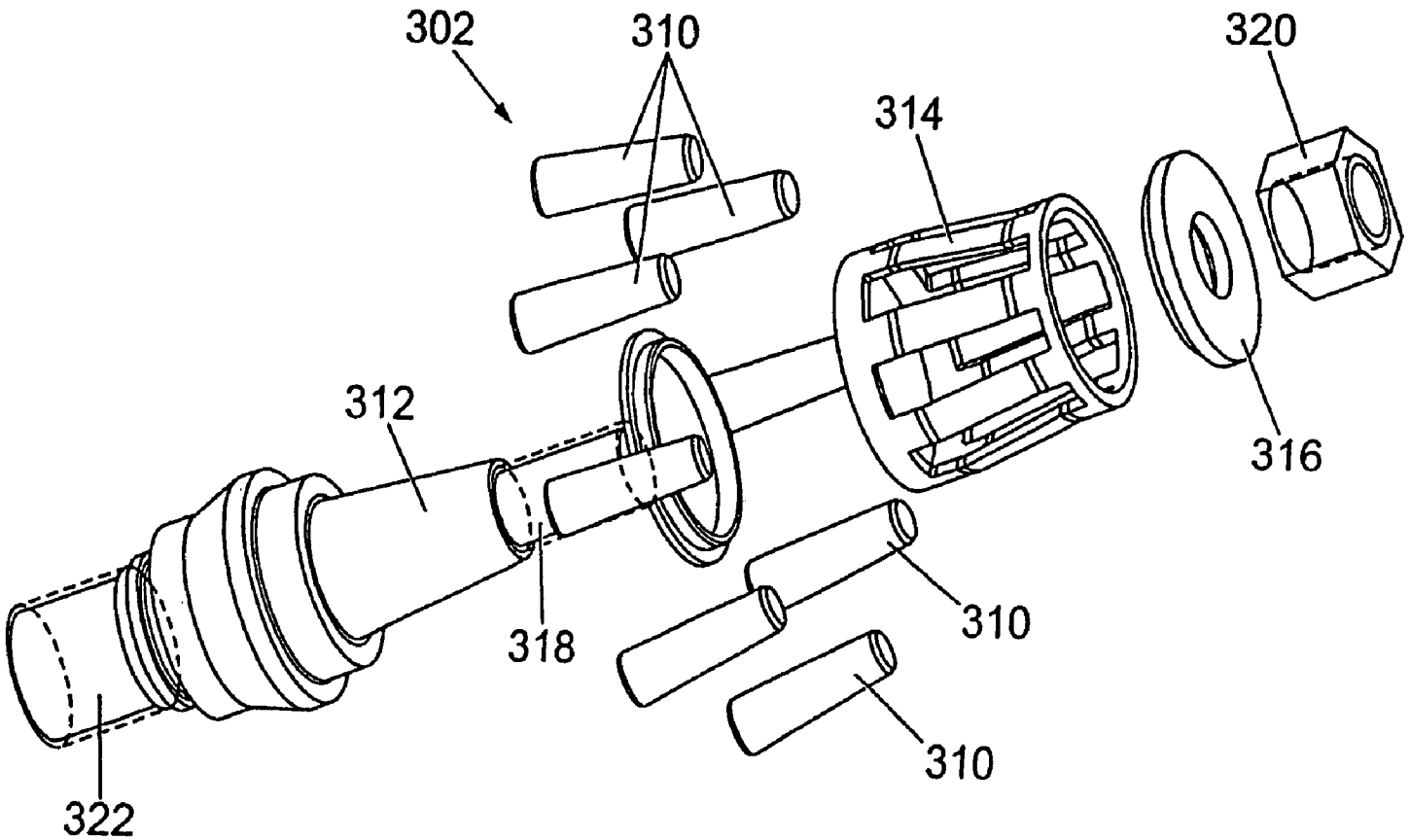
FIG. 21A is an exploded view of the tool part illustrated in FIG. 20.
Figure 22:
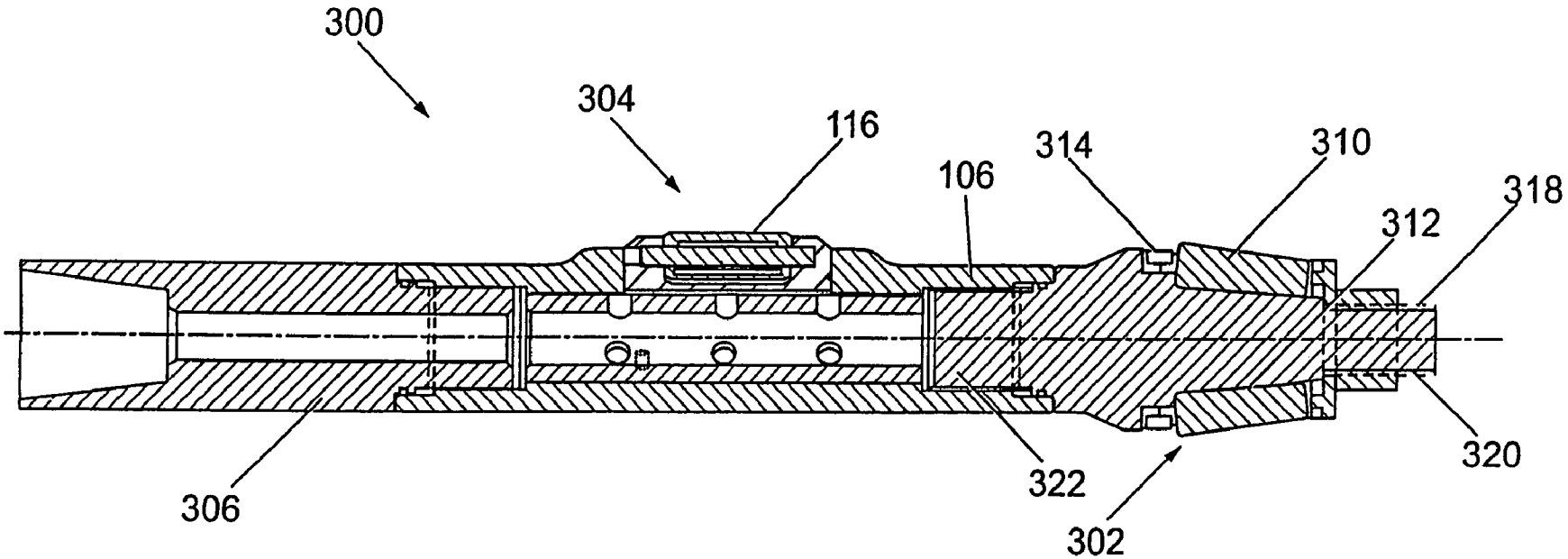
FIG. 22 a longitudinal section of the tool part illustrated in FIG. 20.
Figure 23:
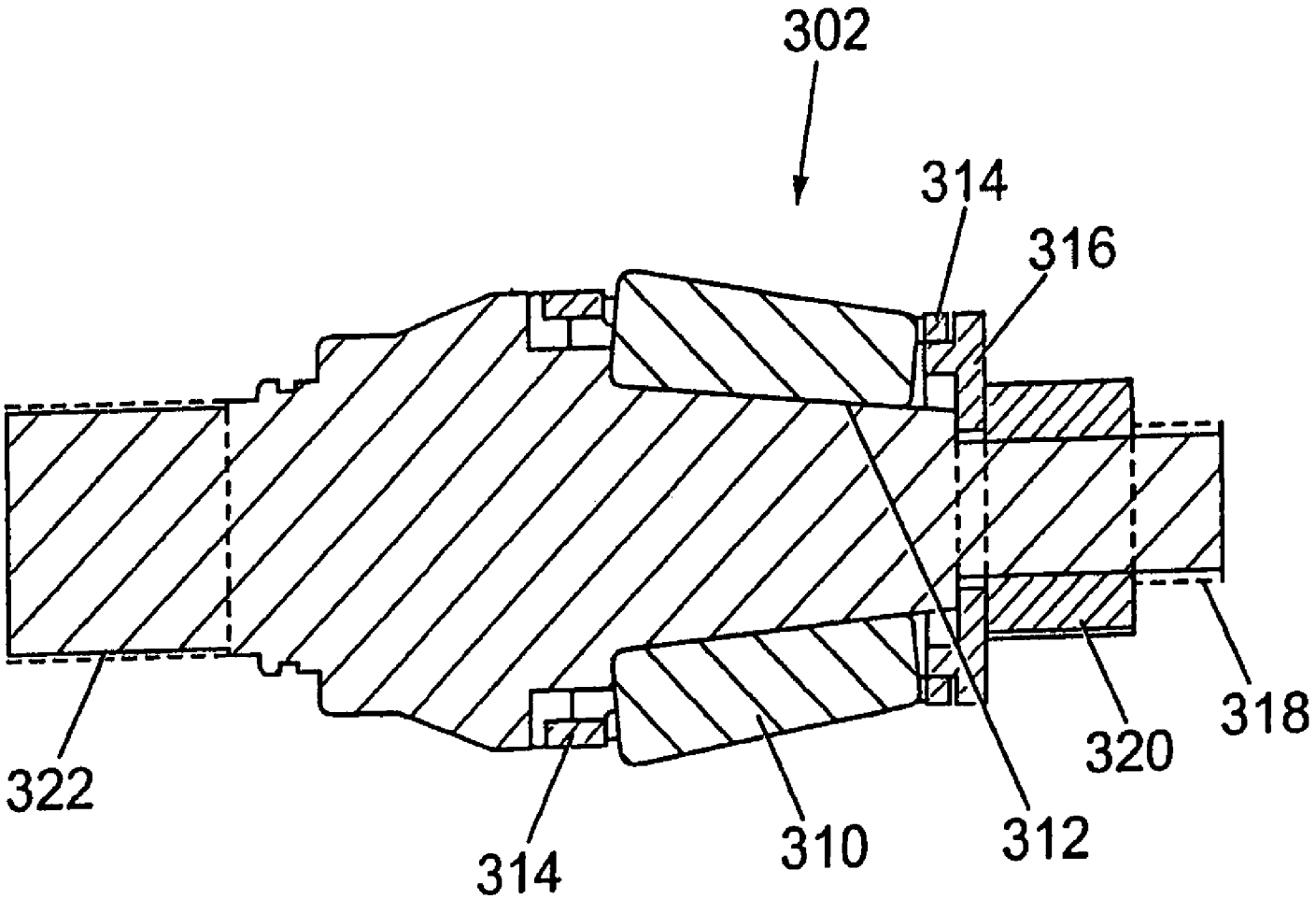
FIG. 23 is a longitudinal section of the expansion tool illustrated in FIG. 21.

From FIGS. 20–24 it will be seen that the general form of the primary expansion tool 302 is that of a roller tool externally presenting a conical array of four tapered rollers 310 tapering towards an imaginary point (not denoted) ahead of the leading end of the expansion tool 300, i.e. the right end of the tool 300 as viewed in FIGS. 20 & 21. As may be more clearly seen in FIGS. 21A, 22, & 23, the rollers 310 run on a conical race 312 integrally formed on the surface of the body of the primary expansion cool 302, the rollers 310 being constrained for true cracking by a longitudinally slotted cage 314. An end retainer 316 for the rollers 310 is secured on the screw-threaded leading end 318 of the primary expansion tool 302 by means of a ring nut 320. The trailing end 322 of the primary expansion tool 302 is screw-threaded into the leading end 106 of the secondary expansion tool 304 to form the composite expansion tool 300. Functioning of the primary expansion tool 300 will be detailed subsequently.

The secondary expansion tool 304 is substantially identical to the previously detailed profiling tool 100 (except for one important difference which is described below), and accordingly those parts of the secondary expansion tool 304 which are the same as corresponding parts of the profiling tool 100 (or which are obvious modifications thereof) are given the same reference numerals. The important difference in the secondary expansion tool 304 with respect to the profiling tool 100 is that the rotation axes of the rollers 116 are no longer exactly parallel to the longitudinal axis of the tool, but are skewed such that each individual roller rotation axis is tangential to a respective imaginary helix, though making only a small angle with respect to the longitudinal direction (compare FIG. 24 with FIG. 4). As particularly shown in FIGS. 20 and 24, the direction (or "hand") of the skew of the rollers 116 in the secondary expansion tool 304 is such that the conventional clockwise rotation of the tool (as viewed from the uphole end of the tool, i.e. the left end as viewed in FIGS. 20 & 22) is such as to induce a reaction against the bore of the casing (not shown in FIGS. 20–24) which tends not only to rotate the tool 300 around its longitudinal axis but also to advance the tool 300 in a longitudinal direction, i.e. to drive the tool 300 rightwards as viewed in FIGS. 20 & 22. (The use of skewed bore-contacting rollers to cause a rotating downhole tool to drive itself along a casing is detailed in the above-mentioned WO93/24728-A1).

In use of the expansion tool 300 to expand casing (not shown) previously deployed to a selected downhole location in a well, the tool 300 is lowered on a drillstring (not shown) or coiled cubing (now shown) until the primary expansion cool 302 at the leading end of the tool 300 engages the uphole end of the unexpended casing. The core of the tool 300 is pressurized to force the roller-carrying pistons 120 radially outwards and hence to force the rollers 116 into firm contact with the casing bore. The tool 300 is simultaneously caused to rotate clockwise (as viewed from its uphole end) by any suitable means (e.g. by rotating the drillstring (if used), or by actuating a downhole mud motor (not shown) through which the tool 300 is coupled to the drillstring or coiled cubing), and this rotation combines with the skew of the rollers 116 of the secondary tool 304 to drive the tool 300 as a whole in the downhole direction. The conical array of rollers 310 in the primary expansion cool 302 forces its way into the uphole end of the unexpended casing where the combination of thrust (in a downhole direction) and rotation rolls the casing into a conical shape that expands until its inside diameter is just greater than the maximum diameter of the array of rollers 310 (i.e. the circumscribing diameter of the array of rollers 310 at its upstream end). Thereby the primary expansion tool 302 functions to bring about the primary or initial expansion of the casing.

The secondary expansion tool 304 (which is immediately uphole of the primary expansion tool 302) is internally pressurized to a pressure which not only ensures that the rollers 116 contact the casing bore with sufficient force as to enable the longitudinal traction force to be generated by rotation of the tool about its longitudinal axis but also forces the pistons 120 radially outwards to an extent that positions the piston-carried rollers 116 sufficiently radially distant from the longitudinal axis of the tool 304 (substantially coincident with the centerline of the casing) as to complete the diametral expansion of the casing to the intended final diameter of the casing. Thereby the secondary expansion tool 304 functions to bring about the secondary expansion of the casing. (This secondary expansion will normally be the final expansion of the casing, but if further expansion of the casing is necessary or desirable, the expansion tool 300 can be driven through the casing again with the rollers 116 of the secondary expansion tool set at a greater radial distance from the longitudinal axis of the tool 304, or a larger expansion tool can be driven through the casing). While the primary expansion tool 302 with its conical array of rollers 310 is preferred for initial expansion of casing, the secondary expansion tool 304 with its radially adjustable rollers has the advantage that the final diameter to which the casing is expanded can be selected within a range of diameters. Moreover, this final diameter can not only be adjusted while the tool 304 is static but can also be adjusted during operation of the tool by suitable adjustment of the extent to which the interior of the tool 304 is pressurized above the pressure around the outside of the tool 104. This feature also gives the necessary compliance to deal with variances in wall thickness.

Figure 24:
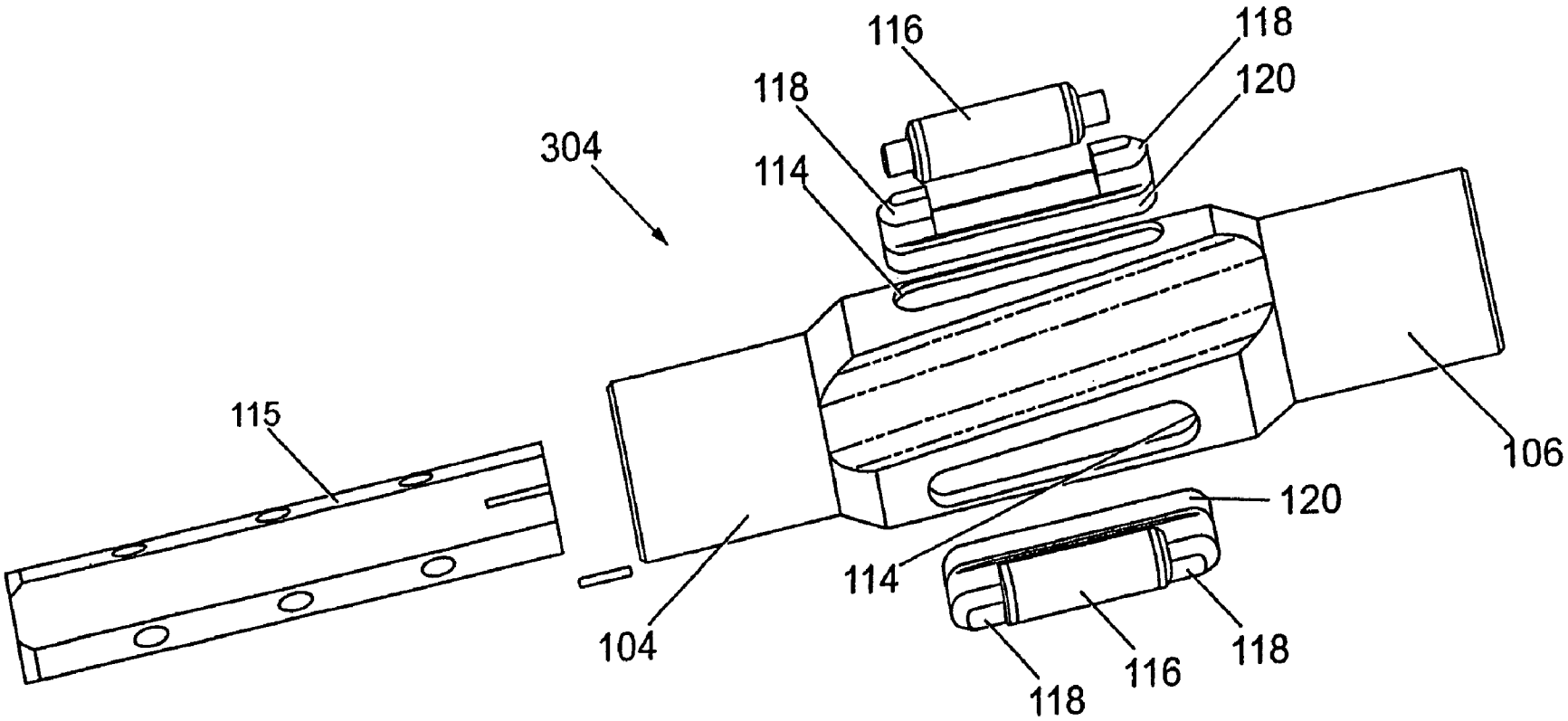
FIG. 24 is an exploded view of part of the expansion tool illustrated in FIG. 20.
Figure 25:
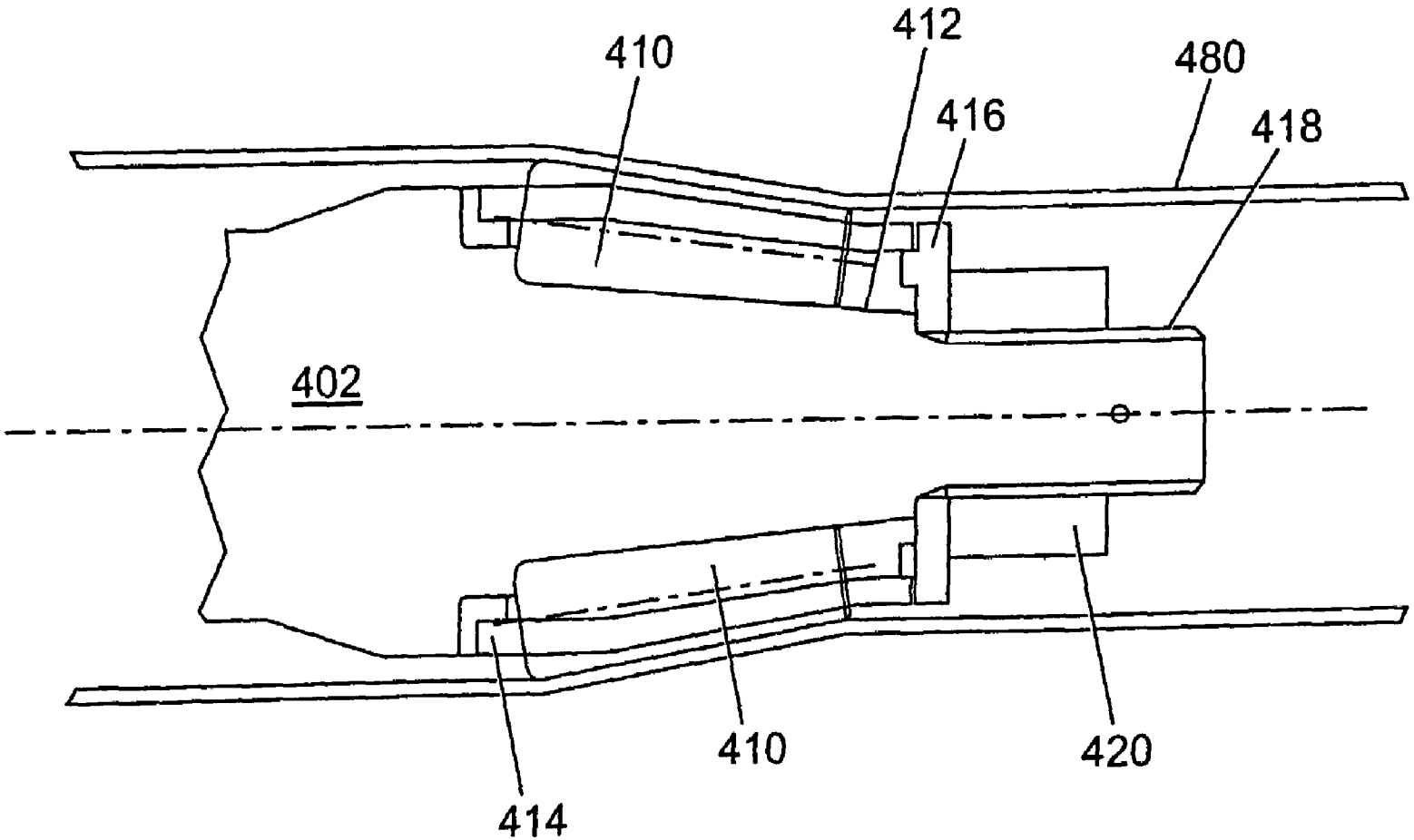
FIG. 25 is a longitudinal section of an alternative form of the tool part illustrated in FIG. 21.

FIG. 25 is a longitudinal section of a primary expansion tool 402 which is a modified version of the primary expansion tool 302 (detailed above with reference to FIGS. 20–24). Components of the tool 402 which correspond to components of the tool 302 are given the sane reference numeral except that the leading "3" is replaced by a leading "4". The tool 402 is essentially the same as the tool 302 except that the rollers 410 are longer than the rollers 310, and the conical race 412 has a cone angle which is less than the cone angle of the race 312 (i.e. the race 412 tapers less and is more nearly cylindrical than the race 312). As shown in FIG. 25, the trailing (uphole) end of the tool 402 is broken away. For details of other parts of the tool 402, reference should be made to the foregoing description of the tool 302. In contrast to FIGS. 20–24, FIG. 25 also shows a fragment of casing 480 which is undergoing expansion by the tool 402.

Figure 26:
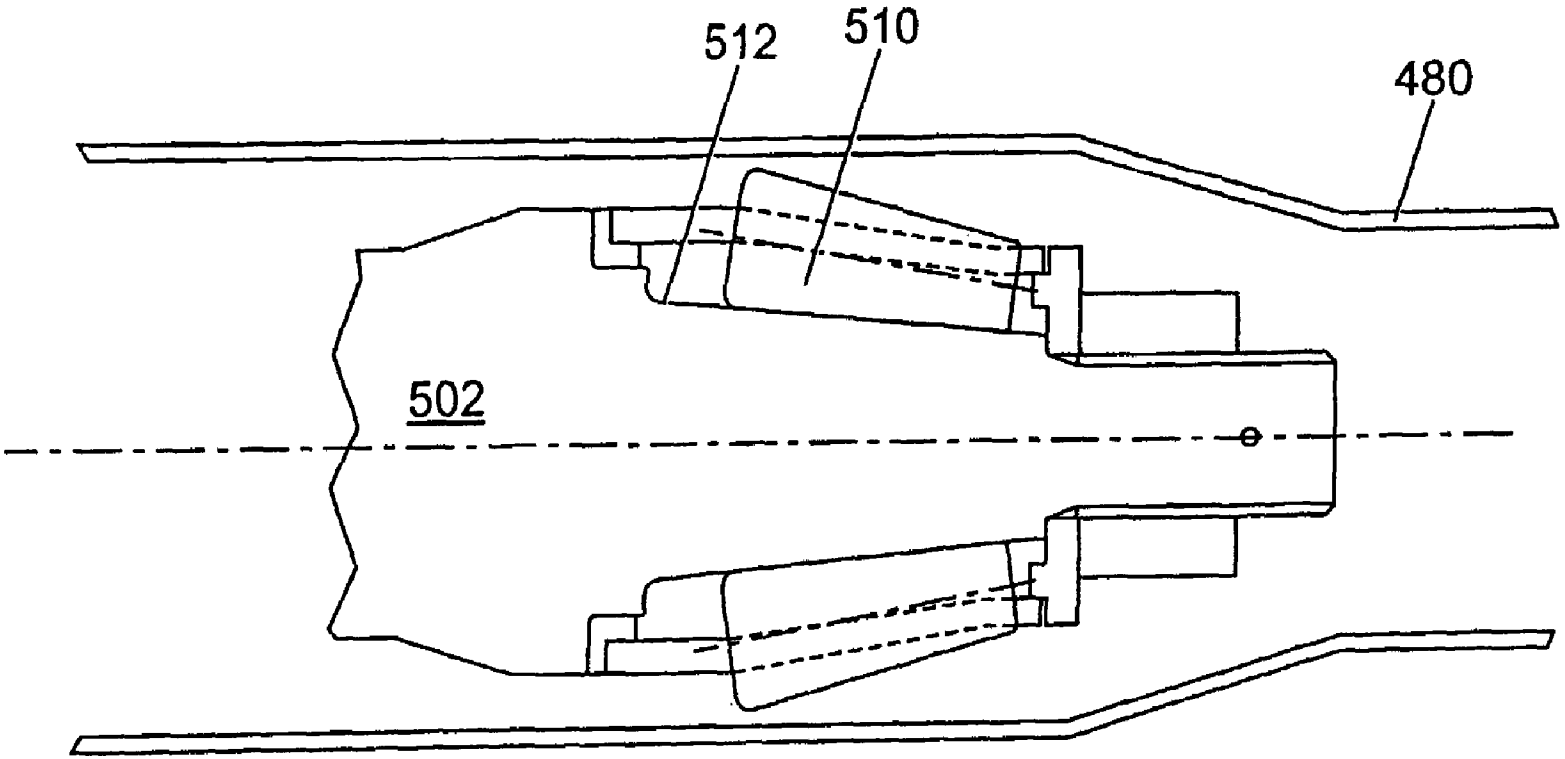
FIG. 26 is a longitudinal section of a technical variant of the tool part illustrated in FIG. 21.

FIG. 26 is a longitudinal section of a primary expansion tool 502 which is a further-modified version of the primary expansion tool 302. Components of the tool 502 which correspond to components of the tool 302 are given the same reference numeral except that the a leading "3" is replaced by a leading "5". The tool 502 is identical to the tool 402 except that the rollers 510 have a length which is somewhat less than the length of the rollers 410. This reduced length allows the rollers 510 some longitudinal freedom within their windows in the cage 514. Consequently, although expansion operation of the primary expansion tool 502 is essentially identical to operation of the primary expansion tool 410 (and similar to operation of the primary expansion tool 310 except for functional variations occasioned by the different conicities of the respective races), reversal of longitudinal thrust on the tool 502 (I.e. pulling the tool 502 uphole instead of pushing the tool 502 downhole) will cause or allow the rollers 510 to slide along the conical race 512 in the direction of its reducing diameter, thus allowing the rollers 510 radially to retract from the casing bore as illustrated in FIG. 26. Such roller retraction frees the tool 502 from the casing 480 and permits free withdrawal of the tool 502 in an uphole direction whereas the non-retracting rollers 410 of the tool 402 might possibly jam the tool 402 within the casing 480 in the event of attempted withdrawal of the tool 402.

Figure 27:
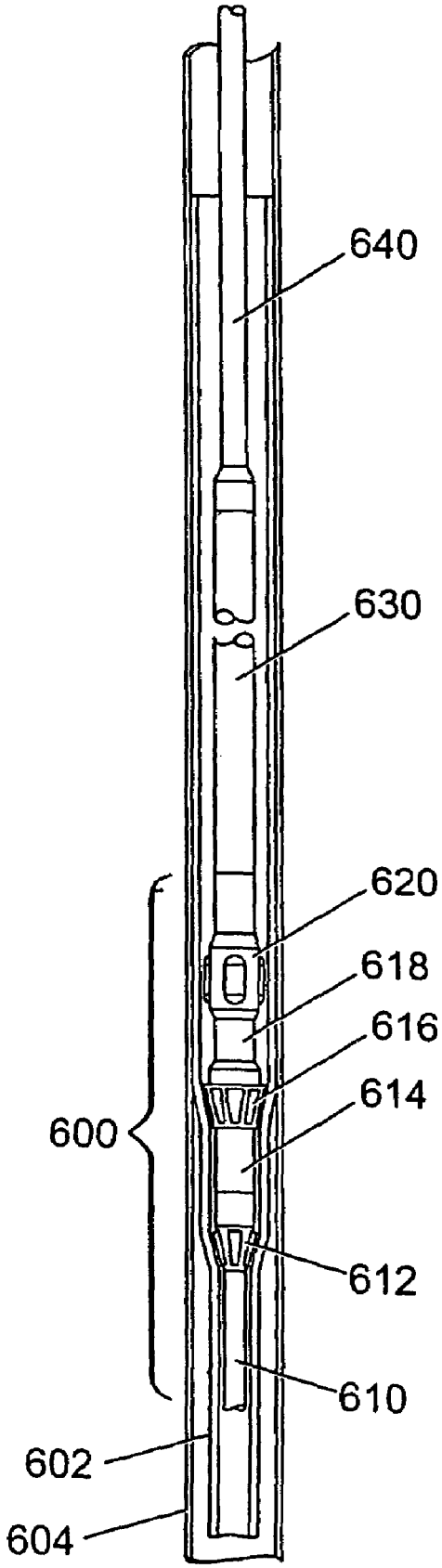
FIG. 27 is a longitudinal elevation of a second embodiment of expansion tool in accordance with the present invention.

Turning now to FIG. 27, this is a simplified longitudinal elevation of a casing expander assembly 600 for use in downhole expansion of a solid, slotted or imperforate metal tube 602 within a casing 604 which lines a well. The casing expander assembly 600 is a three-stage expansion tool which is generally similar (apart from the number of expansion stages) to the two-stage expansion tool 300 described above with reference to FIGS. 20–24.

In order from its leading (downhole) end, the expander assembly 600 comprises a running/guide assembly 610, a first-stage conical expander 612, an inter-stage coupling 614, a second-stage conical expander 616, a further inter-stage coupling 618, and a third-stage cylindrical expander 620.

The first-stage conical expander 612 comprises a conical array of tapered rollers which may be the same as either one of the primary expansion tools 302 or 402, or which differs therefrom in respect of the number of rollers and/or in respect of the cone angles of the rollers and their race.

The second-stage conical expander 616 is an enlarged-diameter version of the first-stage conical expander 612 dimensioned to provide the intermediate expansion stage of the three-stage expansion assembly 600. The diameter of the leading (narrow) end of the second-stage expander 616 (the lower end of the expander 616 as viewed in FIG. 27) is marginally less than the diameter of the trailing (wide) end of the first-stage expander 612 (the upper end, of the expander 612 as viewed in FIG. 27) such that the second-stage expander 616 is not precluded from entering initially expanded tube 602 resulting from operation of the first-stage expander 612.

The third-stage expander 620 is a generally cylindrical expander which may be similar either to the profiling tool 100 or to the secondary expansion tool 304. (Although the rollers of the third-stage expander 620 may be termed "cylindrical" in order to facilitate distinction over the conical rollers of the first-stage and second-stage expanders 612 & 616, and although in certain circumstances such so-called "cylindrical" rollers may in fact be truly cylindrical, the rollers of the cylindrical expander will usually be barreled to avoid excessive end stresses). The rollers of the third-stage expander 620 will normally be radially extended from the body of the expander 620 by an extent that the third-stage expander 620 rolls the tube 602 into its final extension against the inside of casing 604, such that no further expansion of the tube 602 is required in the short term.

The interstage couplings 614 and 618 can be constituted by any suitable arrangement that mechanically couples the three expander stages, and (where necessary or desirable) also hydraulically couples the stage.

The rollers of the third-stage expander 620 may be skewed such that rotation of the assembly 600 drives the assembly in a downhole direction; alternatively, the rollers may be unskewed and forward thrust on the expanders be provided by suitable weights, e.g. by drill collars 630 immediately above the assembly 600. Where the third-stage rollers are skewed, drill collars can be employed to augment the downhole thrust provided by rotation of the assembly 600.

As depicted in FIG. 27, the three-stage expander assembly 600 is suspended from a drillstring 640 which not only serves for transmitting rotation to the assembly 600 but also serves for transmitting hydraulic fluid under pressure to the assembly 600 for radial extension of the third-stage rollers, for cooling the assembly 600 and newly deformed tube 602, and for flushing debris out of the work region.

In suitable circumstances, the drillstring 640 may be substituted by coiled tubing (not shown) of a form known per se.

Figure 28B:
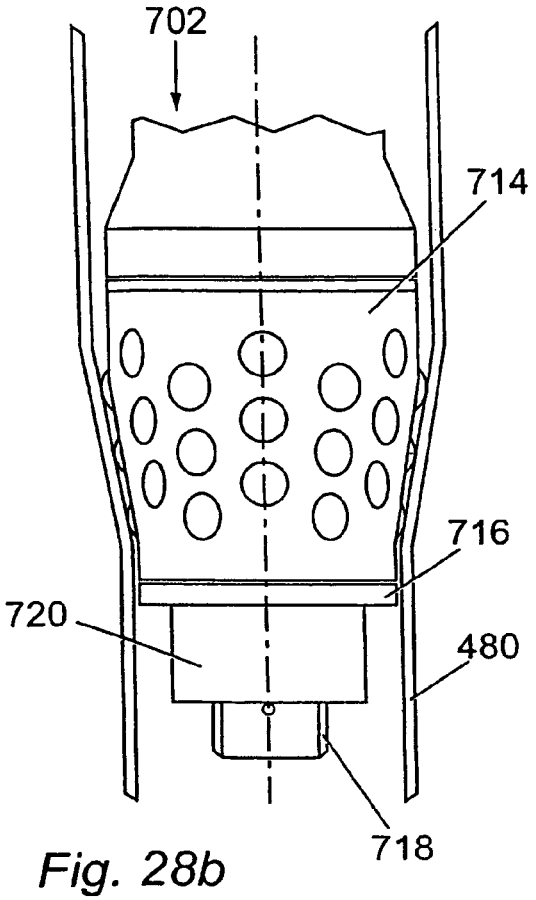
FIGS. 28A, 28B, & 28C are respectively a longitudinal section, a longitudinal elevation, and a simplified end view of a third embodiment of expansion tool in accordance with the present invention.
Figure 28A:
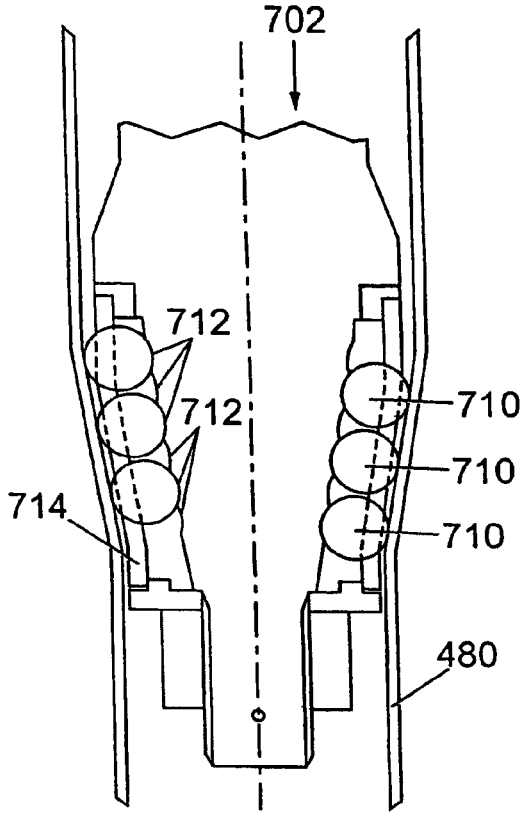
Figure 28C:
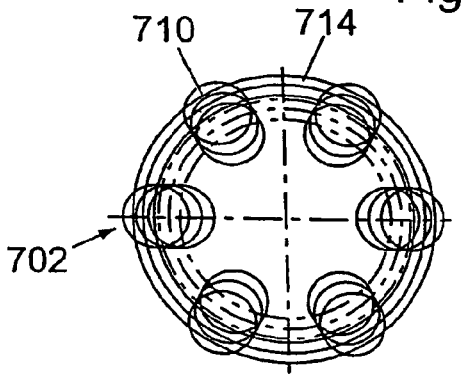

Turning now to FIG. 28 which is divided into three mutually related FIGS. 28A, 28B, & 28C), these illustrate a primary expansion tool 702 which may be summarized as being the primary expansion tool 402 (FIG. 25) with hard steel bearing balls 710 substituted for the rollers 410. Each of the balls 710 runs in a respective circumferential groove 712, and is located for proper tracking by a suitably perforated cage 714. As with the tool 402, the cage 714 is retained by a retainer 716 secured on the screw-threaded leading end 718 of the tool 702 by means of a ring nut 720. Operation of the tool 702 is functionally similar to operation of the tool 402, as is illustrated by the expansion effect of the tool 702 on casing 480.

The primary expansion tool 702 as shown in FIGS. 28A–28C could be modified by the substitution of the series of circumferential ball tricks 712 with a single spiral track (not shown) around which the balls 710 would circulate at ever-increasing radii to create the requisite expansion forces on the casing. At the point of maximum radius, the balls 710 would be recirculated back to the point of minimum radius (near the leading end of the tool 702, adjacent the retainer 716) by means of a channel (not shown) formed entirely within the central body of the tool 702 in a form analogous to a recirculating ball-screw (known per se).

Figure 29A:
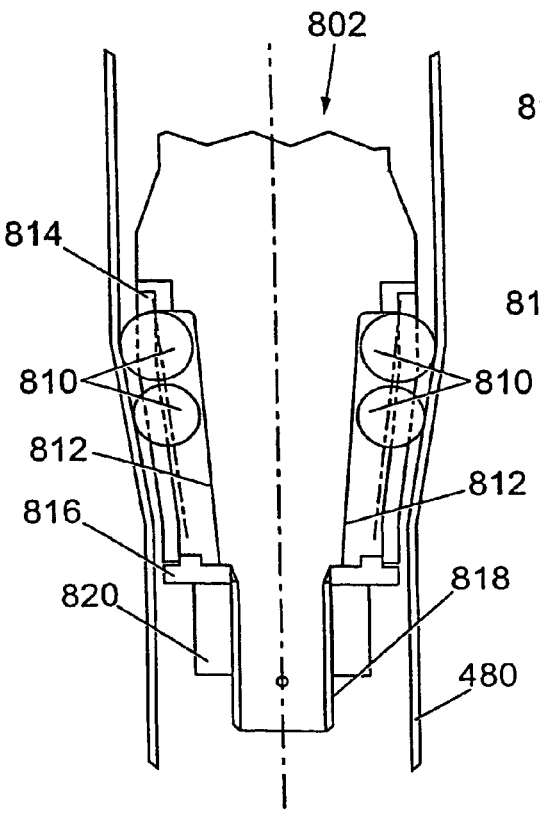
FIGS. 29A & 29B are longitudinal sections of a fourth embodiment of expansion tool in accordance with the present invention, respectively in expanded and contracted configurations.
Figure 29B:
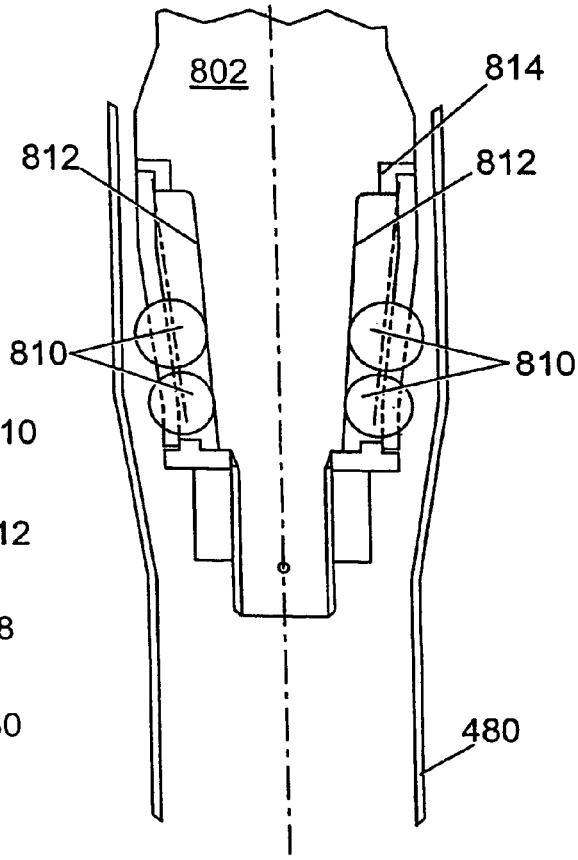

FIGS. 29A & 29B illustrate a modification 802 of the ball-type expansion primary expansion tool 702 of FIG. 28 analogous to the FIG. 26 modification 502 of the FIG. 25 roller-type primary expansion tool 402. In the modified ball-type primary expansion tool 802, the hard steel bearing balls 810 run in longitudinally-extending grooves 812 instead of the circumferential grooves 712 of the tool 702. The ball-guiding perforations in the cage 814 are longitudinally extended into slots which allow individual balls 810 to take up different longitudinal positions (and hence different effective radii) according to whether the tool 802 is being pushed downhole (FIG. 28A) or being pulled uphole (FIG. 28B). In the latter case, the balls 810 are relieved from pressure on the surrounding casing 480 and thereby obviate any risk of the tool 802 becoming jammed in partly-expanded casing.

Figure 4:
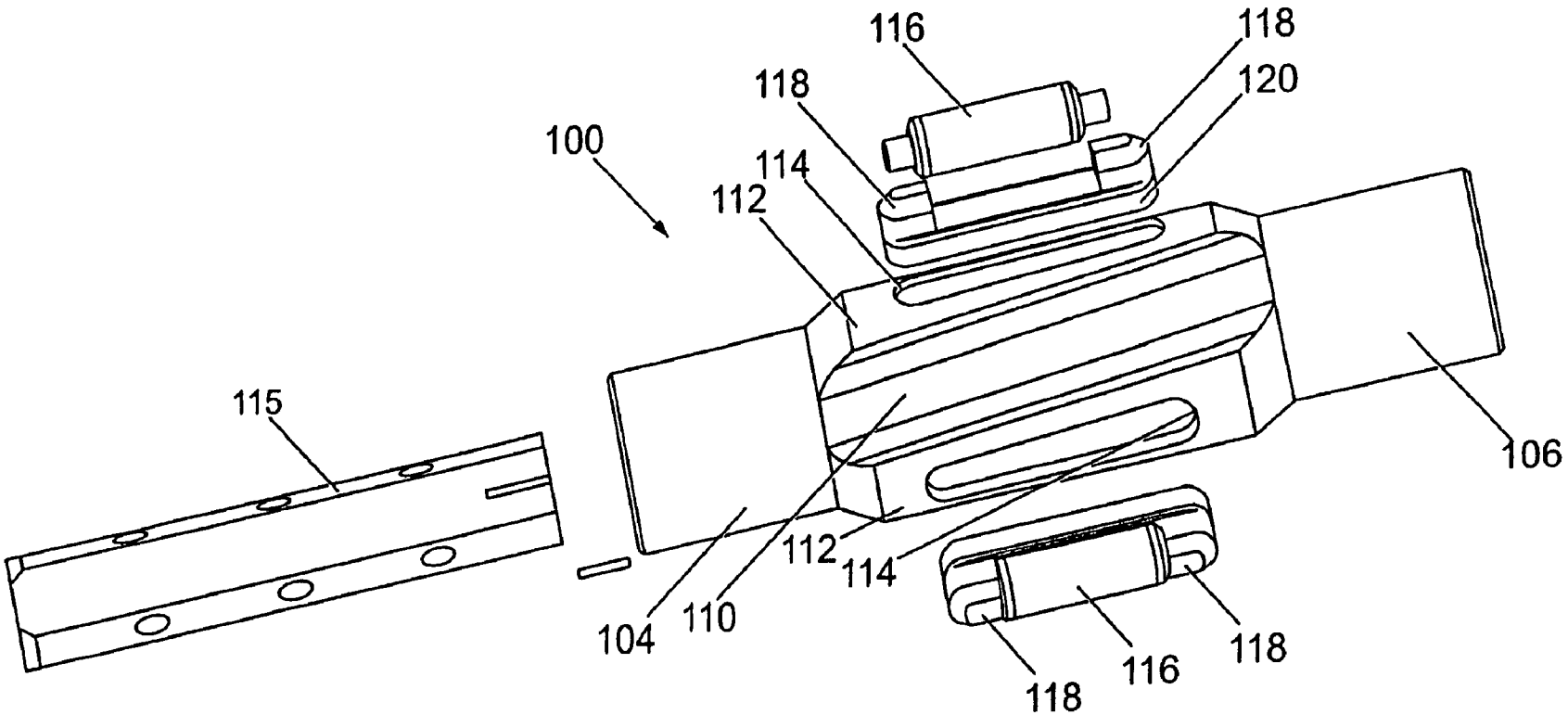
FIG. 4 is an exploded perspective view of the profiling tool of FIGS. 1–4.
Figure 30:
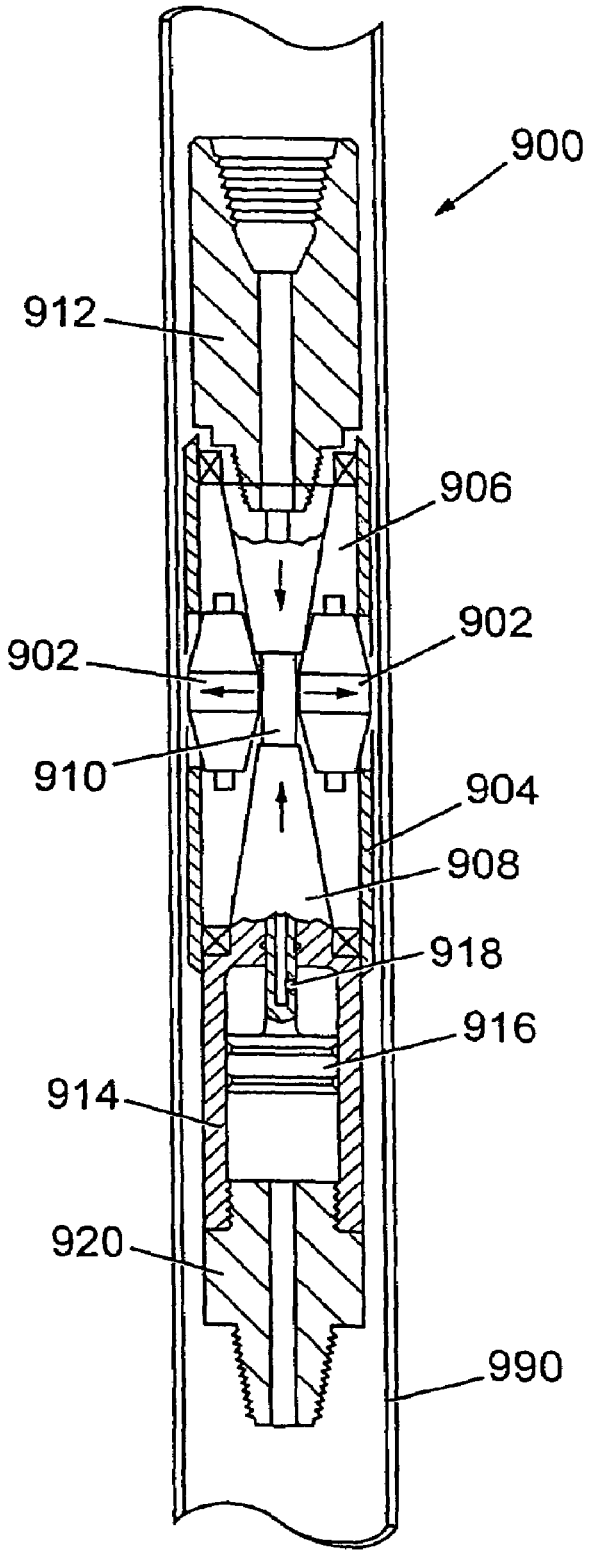
FIG. 30 is a longitudinal section of a fifth embodiment of expansion tool in accordance with the present invention.

In the profiling and expansion tools with controllably displaceable rollers as previously described, e.g. with reference to FIGS. 4 and 24, the ability to obtain and to utilize hydraulic pressure may place practical limits on the forces which can be exerted by the rollers. FIG. 30 illustrates a roller-type expansion/profiling tool 900 which utilizes a mechanical force-multiplying mechanism to magnify a force initially produced by controlled hydraulic pressure, and to apply the magnified force to profiling/expanding rollers 902. Each of the plurality of rollers 902 (only two being visible in FIG. 30) has a longitudinally central portion which is near-cylindrical and slightly barreled (i.e. slightly convex), bounded on either side by end portions which are conical, both end portions tapering from conjunction with the central portion to a minimum diameter at each end. Rotation of each roller 902 about a respective rotation axis which is parallel to the longitudinal axis of the tool 900 and at a controllably variable radial displacement therefrom is ensured by a roller-guiding cage 904 of suitable form.

The effective working diameter of the tool 900 is dependent on the (normally equal) radial displacements of the rollers 902 from the longitudinal axis of the tool 900 (such displacement being shown at a minimum in FIG. 30). The conical end portions of each roller 902 each run on a respective one of two conical races 906 and 908 whose longitudinal separation determines the radial displacement of the rollers 902. The conical races 906 and 909 are coupled for synchronous rotation but variable separation by means of a splined shaft 910 which is rigid with the upper race 906 and non-rotatably slidable in the lower race 908. The tool 900 has a hollow core which hydraulically couples through an upper sub 912 to a drillstring (not shown) which both selectively rotates the tool 900 within surrounding casing 990 which is to be profiled/expanded by the tool 900 and transmits controllable hydraulic pressure to the core of the tool 900 for controlling the roller displacement as will now be detailed.

The lower end of the tool 900 (with which the lower race 908 is integral) is formed as hollow cylinder 914 within which a piston 916 is slidably sealed. The piston 916 is mounted on the lower end of a downward extension of the shaft 910 which is hollow to link through the tool core and the drillstring to the controlled hydraulic pressure. The piston 916 divides the cylinder 914 into upper and lower parts. The upper part of the cylinder 914 is linked to the controlled hydraulic pressure by way of a side port 918 in the hollow shaft 910, just above the piston 916. The lower part of the cylinder 914 is vented to the outside of the tool 900 through a hollow sub 920 which constitutes the lower end of the tool 900 (and which enables further components, tools, or drillstring (not shown)) to be connected below the tool 900). Thereby a controllable hydraulic pressure differential can be selectively created across the piston 916, with consequent control of the longitudinal separation of the two roller-supporting conical races 906 and 908 which in turn controls the effective rolling diameter of the tool 900.

While certain modifications and variations of the invention have been described above, the invention is not restricted thereto, and other modifications and variations can be adopted without departing from the scope of the invention as defined in the appended claims.

The invention claimed is:

1. A method of completing a wellbore comprising:

forming an enlarged inner diameter at the bottom of a first tubular through expansion;

placing the top of a second tubular adjacent the enlarged inner diameter; and expanding a top portion of the second tubular into frictional contact with an interior surface of the enlarged inner diameter at the bottom of the first tubular.

2. A method of completing a wellbore comprising:

expanding a first tubular to a desired monobore diameter;

forming an enlarged inner diameter at the bottom of the first tubular through expansion;

lowering a second tubular through the first tubular;

placing the top of the second tubular adjacent the enlarged inner diameter at the bottom of the first tubular;

expanding the top of the second tubular into frictional contact with an interior surface of the enlarged inner diameter; and expanding the second tubular to the desired monobore diameter.

3. The method of claim 2, wherein the first tubular and second tubular are made of a ductile metal capable of elastic and plastic deformation.

4. The method of claim 2, wherein prior to being expanded, the thickness and geometry of the bottom of the first tubular and top of the second tubular are consistent with the remainder of the first tubular and second tubular respectively.

5. The method of claim 2, wherein the enlarged inner diameter formed at the bottom of the first tubular can be any diameter within a specified range.

6. The method of claim 2, wherein the expansion of the first tubular and the second tubular is accomplished by radial compression, circumferential stretching, or by a combination of such radial compression and circumferential stretching of the pipe.

7. The method of claim 2, wherein the expansion comprises effecting a rolling compressive yield of the tubulars to cause reduction in wall thickness and subsequent increase in circumference resulting in an increase in diameters of the tubulars.

8. The method of claim 2, wherein the expansion of the first tubular is performed by applying a compliant roller system to an inner surface at the bottom of the first tubular.

9. The method of claim 8, wherein the roller system comprises:

an annular body having a longitudinal bore disposed there-through;

one or more recesses formed in an outer surface of the body; and one or more rollers mounted on one or more slidable pistons.

10. A method of completing a wellbore comprising:

expanding a bottom portion of a first tubular with a hydraulically actuated tool, wherein the hydraulically actuated tool comprises:

an annular body having a longitudinal bore disposed there-through;

two or more radially extendable members mounted on slidable pistons, each of the piston having a piston surface on the underside thereof.

11. The method of claim 10, wherein the radially extendable members are extendable within a range, and correspondingly expand the bottom of the first tubular to any internal diameter within the range.

12. The method of claim 11, wherein the radial members are expanded via the fluid pressure on the piston surfaces, and wherein increased fluid pressure results in an increased extension of the radially extendable members.

13. The method of claim 10, further comprising:

positioning the hydraulically actuated tool at a first position within the bottom portion of the first tubular;

expanding the first tubular at the first position to a first enlarged inner diameter, wherein the first enlarged inner diameter can be any diameter within a range;

positioning the hydraulically actuated tool at a second position within the bottom portion of the first tubular; and expanding the first tubular at the second position to a second enlarged inner diameter, wherein the second enlarged inner diameter can be any diameter within a range.

14. A method of forming a seal between two tubular members, the method comprising:

providing a first tubular member having an internal surface and an external surface, the external surface describing a first diameter;

providing at least one recess in said external surface at a seal portion of the first tubular member;

locating a deformable sealing member in the recess such that the sealing member describes an external diameter no greater than said first diameter;

locating the first tubular member within a second tubular member; and expanding at least the seal portion of the first tubular member such that the sealing member engages an inner surface of the second tubular member.

15. The method of claim 14, wherein the seal portion is expanded by rolling expansion, with an expansion member being rotated within the first tubular member with a face in rolling contact with an internal surface thereof.

16. The method of claim 14, wherein the first tubular member is expanded only at or in the region of the seal portion.

17. A seal-forming arrangement comprising:

a first tubular member having an internal surface, and an external surface describing a first diameter, the tubular member defining at least one recess in said external surface at a deformable seal portion of the first tubular member, said seal portion having a wall thickness substantially equal to the wall thickness of the tubular member adjacent said seal portion; and a deformable sealing member in the recess, the sealing member describing an external diameter no greater than said first diameter, wherein expansion of at least the seal portion of the first tubular member increases the diameter of the sealing member to at least said first diameter.

18. The arrangement of claim 17, wherein the sealing member is of an elastomer.

19. The arrangement of claim 17, wherein the sealing member is of a ductile metal.

20. A method for expanding a well bore tubular comprising:

providing an expander having at least one radially extendable member, the radially extendable member having a first unextended position, a second fully extended position and a range of positions between the first and second positions wherein the radially extendable member moves from the first position upon application of a force to the radially extendable member;

locating the expander proximate the well bore tubular;

applying the force to the radially extendable member;

engaging the radially extendable member with an inner diameter of the well bore tubular; and expanding the tubular wherein the radially extendable member is positioned within the range for at least a portion of the expansion.

21. A method for expanding a well bore tubular comprising:

providing an expander having at least one radially extendable member, the radially extendable member having a first unextended position, a second fully extended position and a range of positions between the first and second positions wherein the radially extendable member moves from the first position upon application of a force to the radially extendable member and wherein at least a portion of the force remains applied during the expanding;

locating the expander proximate the well bore tubular;

applying the force to the radially extendable member and maintaining at least a portion of the applied force;

engaging the radially extendable member with an inner diameter of the well bore tubular; and expanding the tubular wherein the radially extendable member is positioned within the range for at least a portion of the expansion.

22. A method of expanding pipes in a wellbore, comprising:

placing a smaller diameter pipe in an overlapping arrangement in the wellbore with a larger diameter pipe; and expanding the pipes radially in an area of overlap whereby the smaller and larger diameter pipes are deformed plastically into a wall of the wellbore therearound.

* * * * *